US010995937B1

(12) United States Patent
Olsson et al.

(10) Patent No.: US 10,995,937 B1
(45) **Date of Patent: *May 4, 2021**

(54) LIGHT FIXTURE WITH INTERNALLY-LOADED MULTILAYER STACK FOR PRESSURE TRANSFER

(71) Applicant: SeeScan, Inc., San Diego, CA (US)

(72) Inventors: Mark S. Olsson, La Jolla, CA (US); Jon E. Simmons, Poway, CA (US); John R. Sanderson, IV, Panama City, FL (US); Aaron J. Steiner, San Diego, CA (US)

(73) Assignee: SEESCAN, INC., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/285,045

(22) Filed: Feb. 25, 2019

Related U.S. Application Data

(63) Continuation of application No. 15/431,588, filed on Feb. 13, 2017, now Pat. No. 10,222,031, which is a (Continued)

(51) Int. Cl.

| | |
|---|---|
| ***F21V 31/00*** | (2006.01) |
| ***F21V 15/01*** | (2006.01) |
| ***F21V 23/00*** | (2015.01) |
| ***F21V 7/00*** | (2006.01) |
| ***F21V 29/89*** | (2015.01) |
| ***F21V 29/70*** | (2015.01) |
| ***F21V 3/00*** | (2015.01) |
| ***H05B 45/10*** | (2020.01) |
| ***H05B 45/37*** | (2020.01) |
| ***H05B 45/50*** | (2020.01) |
| *F21W 131/401* | (2006.01) |

(Continued)

(52) U.S. Cl.

CPC ..... *F21V 15/01* (2013.01); *F21V 3/00* (2013.01); *F21V 7/00* (2013.01); *F21V 23/005* (2013.01); *F21V 29/70* (2015.01); *F21V 29/89* (2015.01); *F21V 31/005* (2013.01); *H05B 45/10* (2020.01); *H05B 45/37* (2020.01); *H05B 45/50* (2020.01); *F21V 13/08* (2013.01); *F21W 2107/20* (2018.01); *F21W 2131/401* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 5,207,499 | A | 5/1993 | Vajda et al. |
| 5,481,433 | A | 1/1996 | Wagner et al. |

(Continued)

*Primary Examiner* — Elmito Breval

(74) *Attorney, Agent, or Firm* — Steven C. Tietsworth, Esq.; Michael J. Pennington, Esq.

(57) ABSTRACT

Submersible lights including housings and a multilayer stack for pressure transfer are disclosed. A transparent pressure-bearing window, a window support structure, a circuit element populated with LEDs, and a pressure support structure may be mounted inside the housing. The support structure may be structured to bear at least some of the pressure applied to the transparent window from external pressure sources. The support structures may also be adapted to transfer thermal energy to an exterior environment such as sea water.

16 Claims, 37 Drawing Sheets

Related U.S. Application Data continuation of application No. 13/623,019, filed on Sep. 19, 2012, now Pat. No. 9,574,760.

(60) Provisional application No. 61/536,512, filed on Sep. 19, 2011.

(51) Int. Cl.

| | |
|---|---|
| *F21Y 115/10* | (2016.01) |
| *F21V 13/08* | (2006.01) |
| *F21W 107/20* | (2018.01) |

(56) References Cited

U.S. PATENT DOCUMENTS

| | | | | |
|---|---|---|---|---|
| 6,203,173 | B1 | 3/2001 | Duff et al. | |
| 6,633,110 | B2 | 10/2003 | McGuire et al. | |
| 7,168,825 | B2 | 1/2007 | McArthur | |
| 7,311,417 | B1 | 12/2007 | Lemke | |
| 7,445,352 | B2 | 11/2008 | Lin | |
| 7,458,330 | B2 | 12/2008 | MacDonald et al. | |
| 7,628,512 | B2 | 12/2009 | Netzel et al. | |
| 7,722,216 | B2 | 5/2010 | Amor et al. | |
| 2008/0130304 | A1 | 6/2008 | Rash et al. | |
| 2008/0198615 | A1* | 8/2008 | Klipstein | F21V 29/74 362/538 |
| 2013/0039043 | A1 | 2/2013 | Doyle | |

* cited by examiner

LIGHT FIXTURE WITH INTERNALLY-LOADED MULTILAYER STACK FOR PRESSURE TRANSFER

CROSS-REFERENCE TO RELATED APPLICATIONS

This application is a continuation of and claims priority to co-pending U.S. patent application Ser. No. 15/431,588, filed Feb. 13, 2017, entitled LIGHT FIXTURE WITH INTERNALLY-LOADED MULTILAYER STACK FOR PRESSURE TRANSFER, which is a continuation of and claims priority to U.S. patent application Ser. No. 13/623,019, now U.S. Pat. No. 9,574,760, filed Sep. 19, 2012, entitled LIGHT FIXTURE WITH INTERNALLY-LOADED MULTILAYER STACK FOR PRESSURE TRANSFER, which claims priority under 35 U.S.C. § 119(e) to U.S. Provisional Patent Application Ser. No. 61/536,512, filed Sep. 19, 2011, entitled LIGHT FIXTURE WITH INTERNALLY-LOADED MULTILAYER STACK FOR PRESSURE TRANSFER. The content of each of these applications is incorporated by reference herein in its entirety for all purposes.

FIELD

The present disclosure relates to light fixtures, and more particularly, light fixtures with multilayer stacks for transferring pressure and thermal energy.

BACKGROUND

Semiconductor LEDs have largely replaced conventional incandescent, fluorescent and halogen lighting sources in many applications due to their long life, ruggedness, color rendering, efficacy, and compatibility with other solid state devices. In marine applications, for example, light emitting diodes (LEDs) are emerging as a desired light source for their energy efficiency, instant on-off characteristics, color purity, and vibration resistance.

LEDs are an efficient light source widely available, having surpassed High Intensity Discharge (HID) lamps in lumens per watt. Different uses of LEDs in various light applications, including use of LEDs in marine environments, offer unique advantages and disadvantages.

For example, underwater lighting devices that use LEDs require designs that compensate for ambient pressure in order to avoid catastrophic failure of all or a portion of the lighting device. Such designs may use a pressure-protected housing to isolate the LEDs from the ambient pressure, or may immerse the LEDs in an inert, non-conductive fluid-filled pressure compensation environment. The disadvantages of fluid-filling an LED light include decreased light beam control and increased contamination of the LED phosphor coating. Thus, protecting LEDs from the external pressure using a pressure-protected housing design instead of a fluid-filled pressure compensation design may be often preferred unless such fluid (or other suitable material) used from pressure compensation can exhibit needed light beam control and resist contamination.

Internal temperature of a lighting device must also be properly managed. As temperature varies, so does an LED's color and/or wavelength. Temperature also affects the lifetime of an LED. Therefore, designs that compensate for temperature are necessary.

It follows that a lighting device designed to address issues associated with ambient pressure and internal temperature may be needed.

SUMMARY

In accordance with the present disclosure, a submersible luminaire may include a forward housing, an aft housing, and a transparent pressure bearing window positioned inside the forward housing. A window support structure may be mounted in the forward housing behind the transparent window, and a water-tight seal may be located between the window and the forward housing. The luminaire may further include a circuit element that may be configured and positioned within the forward housing behind the window support structure or next to the window support structure and behind the window to bear at least some of the ambient pressure applied to the transparent window. At least one solid state light source may be mounted on the circuit element behind the transparent window, and may also bear at least some of the ambient pressure applied to the transport window. The luminaire may further include a pressure support structure positioned in the forward housing and configured to carry at least some of the ambient pressure applied to the window.

BRIEF DESCRIPTION OF THE DRAWINGS

The present application may be more fully appreciated in connection with the following detailed description taken in conjunction with the accompanying drawings.

DETAILED DESCRIPTION

Overview

Figure 1:
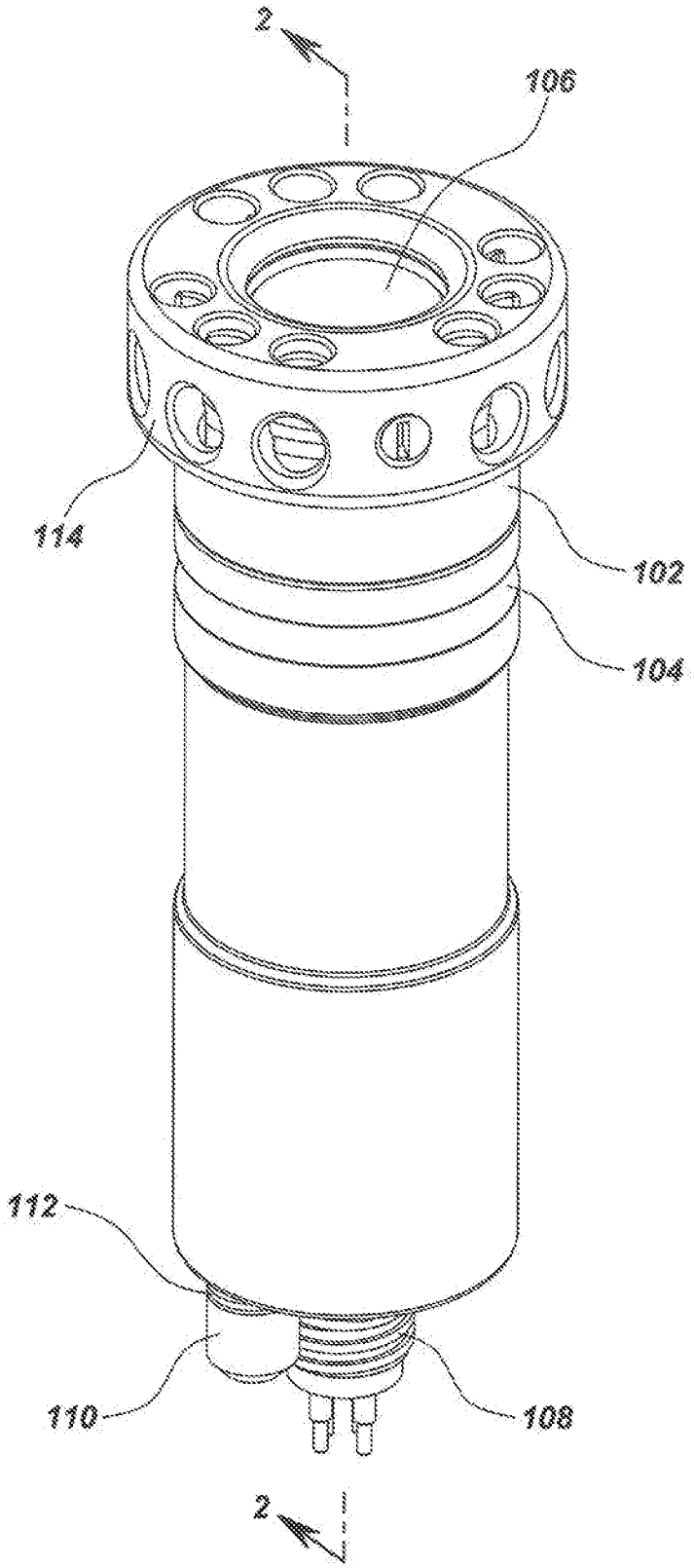
FIG. 1 depicts an isometric view of the exterior of an embodiment of the present disclosure in the form of an underwater multilayer LED light fixture.

One specific advantage of the present disclosure may be its ability to compensate for ambient pressure loads without sacrifice to the quality of light emission from lighting elements (e.g., LEDs, other types of lighting elements). Certain aspects of the disclosure compensate for external pressure using various combinations of components that may vary in design, and that are positioned with respect to each other in various configurations.

Various aspects and details of elements which may be used in embodiments of the present disclosure, such as those described in co-assigned patent applications, including, for example, U.S. patent application Ser. No. 12/815,361, entitled Submersible Multi-Color LED Illumination System, filed Jun. 14, 2010, U.S. patent application Ser. No. 13/460,731, entitled LED LIGHTS AND METHODS FOR FABRICATION, filed Apr. 30, 2012, U.S. patent application Ser. No. 12/185,007, entitled Deep Submersible Light with Pressure Compensation, filed Aug. 1, 2008, U.S. patent application Ser. No. 13/252,182, entitled DEEP SUBMERSIBLE LIGHT WITH PRESSURE COMPENSATION, filed Oct. 3, 2011, U.S. patent application Ser. No. 12/700,170, entitled LED LIGHTING DEVICES WITH ENHANCED HEAT DISSIPATION, filed Feb. 4, 2010, U.S. patent application Ser. No. 13/460,654, entitled LED LIGHTING DEVICES WITH ENHANCED HEAT DISSIPATION, filed Apr. 30, 2012, U.S. patent application Ser. No. 12/844,759, entitled Submersible LED Light Fixture with Multiple Stack for Pressure Transfer, filed Jul. 27, 2010, U.S. Provisional patent application Ser. No. 13/236,561, entitled LED Spherical Light Fixtures with Enhanced Heat Dissipation, filed Sep. 19, 2011, U.S. Provisional patent application Ser. No. 13/482,969, entitled SEMICONDUCTOR LIGHTING DEVICES AND METHODS, filed May 29, 2012, U.S. Provisional patent application Ser. No. 13/271,166, entitled PATHWAY ILLUMINATION DEVICES, METHODS, AND SYSTEMS, filed Oct. 11, 2011, U.S. Provisional Patent Application Ser. No. 61/536,512, entitled LIGHT FIXTURE WITH INTERNALLY-LOADED MULTI-LAYER STACK FOR PRESSURE TRANSFER, filed Sep. 19, 2011, and U.S. Provisional Patent Application Ser. No. 61/553,123, entitled LED LIGHTING DEVICES AND SYSTEMS FOR MARINE AND SHORELINE ENVIRONMENTS, filed Oct. 28, 2011. The content of each of these applications is incorporated by reference herein in its entirety. This application is related by common inventorship to U.S. patent application Ser. No. 12/844,759 of Jul. 27, 2010 by Mark Olsson, et al., entitled "Submersible LED Light Fixture with Multiple Stack for Pressure Transfer," the contents of which are hereby incorporated by reference herein in their entirety for all purposes. This application is related by common inventorship to U.S. Patent Application 61/384,128 of Sep. 17, 2010 and its corresponding utility application by Mark Olsson, entitled "LED Spherical Light Fixtures with Enhanced Heat Dissipation," the contents of which are hereby incorporated by reference herein in their entirety for all purposes.

For example, one aspect of the disclosure relates to a submersible luminaire that includes a forward housing, a transparent, pressure-bearing window positioned inside the forward housing, a water-tight seal disposed between the window and a surface of the forward housing, a window support structure positioned in the forward housing behind a portion of the window, a circuit element positioned within the forward housing, at least one light source mounted on the circuit element and positioned behind the window, and an internally-mounted pressure support structure positioned in the forward housing and configured to carry a first load exerted by the window. The luminaire may also include an aft housing that couples to the forward housing. An end cap, cover, plug, or a hollow screw may be substituted for the aft housing.

Another aspect relates to assembly of a luminaire. The luminaire may be assembled by placing a water-tight seal (e.g., an O-ring) into a notch of a forward housing, inserting a window through an aft opening of the forward housing and positioning the window at a forward end of the forward housing so a portion of the window physically contacts water-tight seal. Additional components may be similarly inserted into the forward housing through the aft opening, forming a stack of components behind the window. Such components may include a window support structure, a circuit element populated with at least one light source, and an internally-mounted pressure support structure. Some or all of these components may be configured to carry a first load transferred by the window from pressure on the outer front face of the window.

Another aspect of the disclosure relates to a forward housing that includes one opening having a first diameter, and another opening having a second diameter that may be larger than the first diameter. The forward housing further includes threads that are formed on an inside surface area of the forward housing near the larger-diameter opening, and that are capable of circumscribing complimentary threads that are formed on an outside surface area of an aft housing near an opening of the aft housing. In accordance with this aspect, a window with a diameter that may be larger than the first diameter and smaller than the second diameter may be inserted into the forward housing.

Another aspect of the disclosure relates to one or more contact surfaces of the forward housing that are configured to deliver thermal energy to corresponding one or more contact surfaces of the aft housing.

Various aspects of the disclosure relate to a pressure support structure configured to bear ambient pressure exerted onto a window. One aspect of the disclosure relates to a pressure support structure with threads that are formed on an outside surface area of the pressure support structure. These threads may be circumscribed by at least a portion of threads formed on an inside surface area of a forward housing, thereby coupling the pressure support structure to the forward housing. Another aspect of the disclosure relates to one or more fasteners that couple a pressure support structure to a forward housing. Another aspect of the disclosure relates to a retaining ring positioned inside a forward housing behind a pressure support structure, wherein the retaining ring operates to hold the pressure support structure in a first position inside the forward housing. The retaining ring may snap into place, be screwed into place, or fastened into place. Another aspect of the disclosure relates to a coupling of an aft housing to a forward housing that operates to hold a pressure support structure in a first position inside the forward housing.

In accordance with certain aspects of the disclosure, optionally all, some, or none of the pressure carried by the pressure support structure may be transferred to and carried by an aft housing, end cap, cover, plug, hollow screw, snap ring or threaded ring. In association with other aspects, pressure carried by the pressure support structure may be carried on an outside surface area of the pressure support structure with threads that mate with threads on a forward housing. Alternatively, the pressure may be carried by the pressure support structure on one or more surface areas in contact with one or more fasteners that fasten the pressure support structure to a forward housing.

Another aspect of the disclosure relates to an external pressure that applies a load onto a window that may be transferred from the window to a pressure support structure through one or more intervening structures, including a window support structure. Another aspect of the disclosure relates to a load exerted onto a window that may be transferred from the window to a pressure support structure through one or more intervening structures, including a circuit element.

Another aspect of the disclosure relates to a pressure support structure that may be configured to remove thermal energy generated by the at least one light source. Another aspect of the disclosure relates to one or more contact surfaces of a pressure support structure that are configured to exchange thermal energy with corresponding one or more contact surfaces of a forward housing or corresponding one or more contact surfaces of an aft housing.

Another aspect of the disclosure relates to at least one light source that comprises one or more LEDs. A configuration of the LEDs may provide a wide beam of light, a narrow beam of light, or some other beam characteristic. The LEDs may provide any color of light, and may be used as a heat source.

Another aspect of the disclosure relates to a circuit element that may be positioned behind a window support structure that surrounds each of the LEDs. Alternatively, the circuit element may be positioned behind a window and next to the window support structure, whereby the window support structure surrounds the circuit element. Lighting elements that are coupled to the circuit element may be configured to carry a load exerted by the window. One of ordinary skill in the art will appreciate alternatives that are within the scope and spirit of the disclosure.

Another aspect of the disclosure relates to a window support structure that may be configured to carry a load exerted by the window in response to ambient water on an exterior side of the window. A circuit element may be positioned behind the window support structure and configured to carry a load exerted by the window support structure. A pressure support structure may be positioned behind the window support structure and/or the circuit element and configured to carry a load exerted by the window support structure and/or the circuit element. Alternatively, one or more intervening components may be positioned between the circuit element, the window support structure and/or the pressure support structure. Those intervening components may similarly carry a load exerted by the window. Any intervening component may be made of a high compressive strength material configured to carry one or more loads exerted by the window.

Another aspect of the disclosure relates to any of the above luminaires that further include a window that may be made of a material selected from the group consisting of glass, borosilicate glass, plastic, sapphire or other suitable high strength transparent materials. The luminaires further include a water-tight seal comprising an O-ring, an external reflector accessory, a filter adaptor (e.g., for UV filtering), and/or anti-rotation pins configured to maintain the placement of particular components/elements in the luminaire (e.g., stacked components in the forward housing).

Another aspect of the disclosure relates to a spring that may be configured to maintain a thermal connection between a circuit element and a pressure support structure or an intervening component between the circuit element and the pressure support structure. A spring may be configured to carry thermal energy away from a circuit element to a window support structure or a window. Springs may be made of any material, including Beryllium Copper or another thermally conductive material. Another aspect of the disclosure relates to a luminaire with a window or a spring that provides thermal clamping for a circuit element (e.g., a LED circuit board).

Another aspect of the disclosure relates to one or more driver circuit components, and a flexed metal sheet coupled to the one or more driver circuit components inside a housing. The spring force of the flexed metal sheet may operate on the one or more driver circuit components to create a friction lock between the one or more driver circuit components and an inside surface area of the housing. The flexed metal sheet may be made of a thermally conductive material that carries thermal energy from the one or more driver circuit components to an inner surface area of the housing. The spring force of the flexed metal sheet may operate to protect the one or more driver circuit components from certain vibrations or other mechanical movements of the housing in relation to the one or more driver circuit components. At least one portion of the flexed metal sheet may contact at least one component of the one or more driver circuit components to carry thermal energy away from the at least one component of the one or more driver circuit components. The flexed metal sheet may include one or more bent portions, holes, notches or other cutouts and formations that allow threading, insertion or other positioning of one or more wires that are connected to the one or more driver circuit components. In one embodiment, the flexed metal sheet elastically loads the circuit board edges against the inner housing walls thereby providing a direct thermal clamp and connection to the housing walls which are cooled by water externally. In another embodiment the flexed metal sheet has bent edges that elastically clamp to the circuit board edges and the heat may be carried into the flexed metal sheet and then into the inner walls of the housing.

Another aspect of this disclosure relates to thermal transfer along a large inner surface area of an outer housing's wall, which may be made of a high-strength, and low-corrosion material that is suitable for contact with an external environment (e.g., the marine environment at various depths). Suitable materials like titanium and stainless steel typically provide low thermal conductivity, and a particular thinness of the wall may be needed to maintain desired heat transfer characteristics from components positioned inside the outer housing to the external environment. The outer housing's wall may be thinner than a threshold thickness needed to withstand pressures exerted by the external environment where internal pressure support structures are used to carry part of the external environment's load. Such internal pressure support structures may be made of thermally conductive materials like copper and aluminum that would otherwise corrode when in contact with the external environment. The internal pressure support structures may be further configured to contact a large inner surface area of the outer housing's thin wall to optimize thermal transfer of heat generated by circuit elements and LEDs. Accordingly, it is contemplated that luminaires may be designed to optimize desired characteristics in terms of strength, corrosion-resistance, and thermal conductivity.

Various thermal pathways are contemplated, including threads coupling a pressure support structure and a forward housing, threads coupling a forward housing to an aft housing, respective contact surface areas of an aft housing and a pressure support structure, a window in contact with the external environment, and respective contact surface areas of a forward housing and layers of a pressure support stack.

Another aspect of this disclosure relates to an outer housing made from a first material and at least one internal component disposed inside the outer housing and made from a second material. The properties of the first material may include high corrosion resistance and low thermal conductivity relative to properties of the second material that include low corrosion resistance and high thermal conductivity. The first material may be selected from the group consisting of titanium, stainless steel and a nickel-based alloy, and the second material may be selected from the group consisting of a copper-based alloy and an aluminum-based alloy.

One of various aspects of this disclosure may relate to an inner surface area of an outer housing and a surface area of an internal component that thermally couple to each other across an area defined by a height and a width (e.g., a radial width) that are each substantially longer than an average length of thicknesses between the inner surface area and a corresponding outer surface area of the outer housing. For example, a substantially longer length may be twice as long or longer.

One of various aspects of this disclosure may relate to a thickness of an outer housing that is configured to collapse at a certain pressure (e.g., a pressure at a particular marine depth), and an internal component that is configured to support the outer housing so as to prevent its collapse at the pressure.

One of various aspects of this disclosure may relate to a non-radial length of thermal contact between an inner surface of a housing and a surface of an internal pressure support structure. The non-radial length may be at least two times greater than a length of thickness between an outer surface and the inner surface of the housing along the non-radial length of thermal contact.

One of various aspects of this disclosure may relate to one or more thermal energy transfer areas between an inner wall of an outer housing and at least one internal component. In accordance with some aspects, a transfer area may cover a substantial amount (e.g., greater than 50%) of the inner wall.

Another aspect of this disclosure relates to a forward housing and an aft housing (or other numbers of housings, including only one housing), a light source disposed in the forward housing, one or more electronic components configured to provide current control to the light source disposed in the aft housing, and one or more absorbent or adsorbent components disposed in the forward housing or the aft housing, wherein the one or more absorbent or adsorbent components are in either housing. A seal may be configured to prevent an aft substance in the aft housing from entering the forward housing, when absorbent or adsorbent components are positioned in the forward housing. The aft substance may include gas emitted from the one or more electronic components.

Similar aspects of the disclosure may relate to a channel connecting an absorbent or adsorbent component to a volume adjacent to a light source which may be configured to allow one or more substances to pass from the volume to the absorption or adsorption component.

Similar aspects of the disclosure may relate to a transparent, pressure-bearing window positioned in a forward housing, a forward chamber formed at least by a surface of a light source and a surface of the window, and a channel disposed between one or more absorbent or adsorbent components and the forward chamber so as to allow one or more substances to pass from the forward chamber to the one or more absorption or adsorption components.

Similar aspects of the disclosure may relate to one or more absorbent or adsorbent components disposed in an aft housing where a channel connects a forward housing and the aft housing so as to allow one or more substances to pass from the forward housing to the aft housing where the absorbent/adsorbent components reside.

Another aspect of this disclosure relates to a thermal coupling layer formed from a material with a higher thermal transfer capability along a lateral surface plane of the thermal coupling layer as compared to a thermal transfer capability through an internal volume of the thermal coupling layer. Similarly, another aspect of this disclosure relates to a thermal coupling layer that thermally couples to a light source, a pressure support structure, and a window support structure. Yet another aspect of this disclosure relates to a layer of pyrolytic graphite that transfers thermal energy to and from various components.

Various additional aspects, details, features, and functions are described below in conjunction with the appended figures. The following exemplary embodiments are provided for the purpose of illustrating examples of various aspects, details, and functions of the present disclosure; however, the described embodiments are not intended to be in any way limiting. It will be apparent to one of ordinary skill in the art that various aspects may be implemented in other embodiments within the spirit and scope of the present disclosure.

It may be noted that as used herein, the term, "exemplary" means "serving as an example, instance, or illustration." Any aspect, detail, function, implementation, and/or embodiment described herein as "exemplary" is not necessarily to be construed as preferred or advantageous over other aspects and/or embodiments.

Exemplary Embodiments

Certain features of the disclosure are depicted in the Figures. Turning to FIG. 1, for example, an isometric view of the exterior of an embodiment of the present disclosure in the form of an underwater multilayer LED light fixture may be illustrated. The light fixture in FIG. 1 includes a forward pressure housing 102 and aft pressure housing 104 that couple to each other. As will be illustrated in later figures, the aft housing 104 may screw into the forward housing 102. Example materials that may be used to form some or all of the housings 102 and 104 include materials that may be highly resistant to corrosion and that may not be highly thermally conductive. Such suitable materials may include titanium, stainless steels, nickel-based alloys, or other super alloys/high-performance alloys with varying percentages of the elements molybdenum, chromium, cobalt, iron, copper, manganese, titanium, zirconium, aluminum, carbon, and tungsten. Plastics may also be used.

A crash guard 114 surrounds and protects a window 106 which resides within the forward pressure housing 102. The crash guard 114 may be constructed of strong materials, such as plastics or polymers, to provide high impact strength to deflect foreign object impacts and the like. Alternatively, the crash guard 114 may be constructed of strong materials (e.g., titanium, stainless steels, nickel-based alloys) to provide high impact strength to protect the window 106 from side and front impacts.

Similarly, the window 106 may be constructed from a strong transparent material that may be thermally conductive, such as sapphire or another suitable material, for providing optical clarity for the passage of light, mechanical strength to resist external pressure, and heat dissipation. The crash guard 114 may protect the window 106 from side impacts.

The light fixture also includes an electrical connector 108 that may be mounted on the rear of the aft housing, permitting connection to an electrical power supply (not illustrated). A sacrificial anode 110, made of an anode grade zinc or magnesium, provides galvanic corrosion protection. A nylon washer 112 physically isolates the flat bottom contact surface of the anode 110 from the lower portion aft housing 104 depicted in FIG. 1. An internal threaded screw (not shown) electrically connects the anode 110 to the housing.

Figure 2:
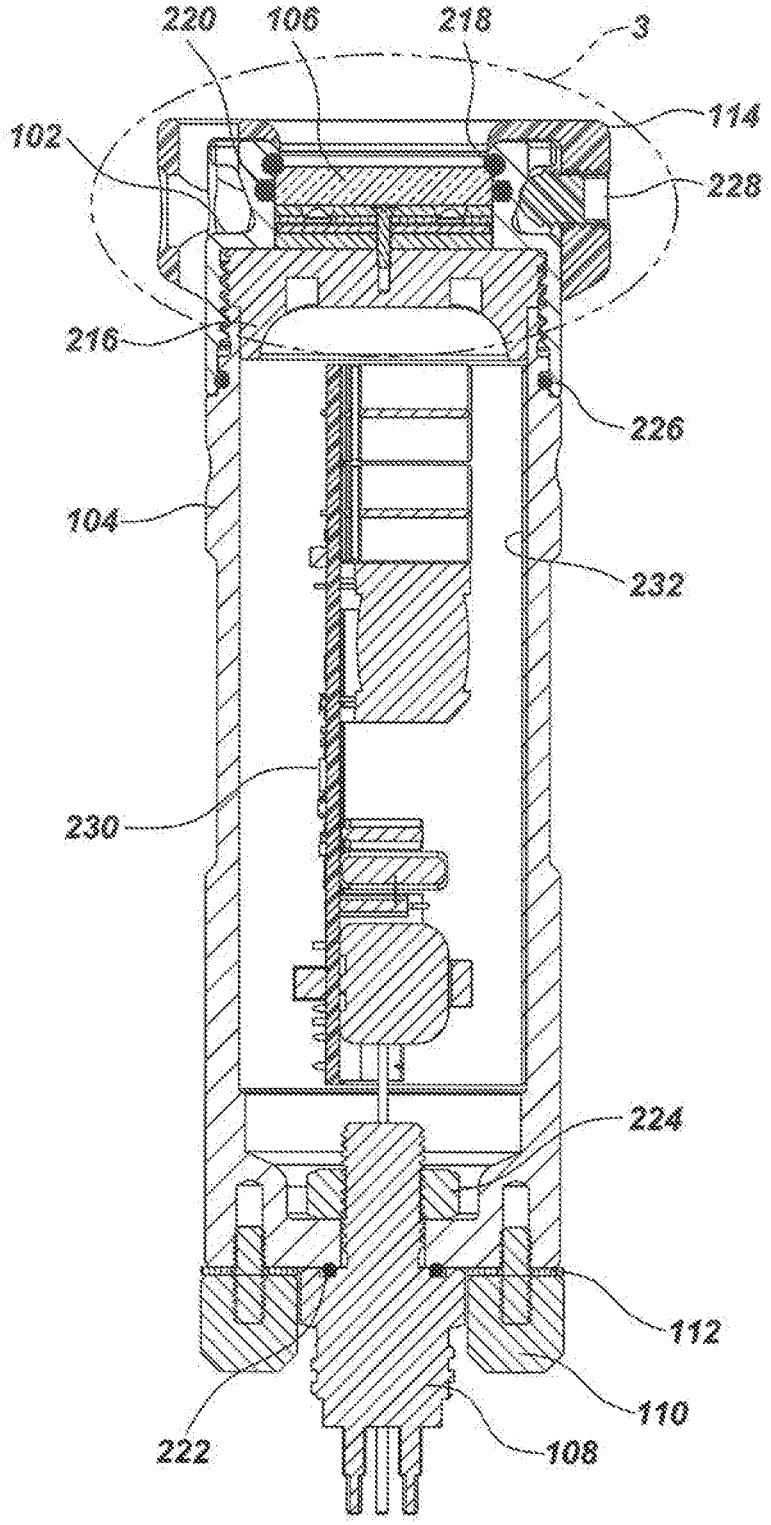
FIG. 2 is a vertical sectional side view of the underwater multilayer LED light fixture of FIG. 1.

FIG. 2 depicts a vertical sectional side view, taken along dimension 2-2 of FIG. 1, of the underwater multilayer LED light fixture of FIG. 1. As shown, the aft housing 104 couples to the forward housing 102 (e.g., by screwing into the forward housing 102). One or more fasteners 228 (e.g., n circumferentially-spaced, retaining ball tip set screws) may be used to secure the crash guard 114 to the forward housing 102. FIG. 2 illustrates a stack subassembly inside the forward housing 104, comprising a pressure support structure 216 configured to carry at least part of a load exerted onto the window 106 by external pressure (e.g., pressure associated with depths in a marine environment). The pressure support structure 216 may be formed of various materials, including thermally-conductive materials such as copper, aluminum and conductive alloys so as to permit heat transfer to and from neighboring components.

Other aspects of the stack subassembly are illustrated in FIGS. 3-16, 20-21 and 25, which are described in more detail below.

FIG. 2 further depicts several components that create a watertight seal. For example, a forward window sealing/compressing O-ring 218 may be positioned in a groove in the forward housing 102 between a beveled edge of the window 106 and a lip of the forward housing 102. A side window sealing O-ring 220 may be positioned in a groove in the forward housing 102 between the window 106 and an internal wall of the forward housing 102. The two O-rings 218 and 220 operate to create a watertight seal that prevents water from entering the inside of the forward housing 102 through the opening that receives the window 106. Another O-ring, a connector sealing O-ring 222, prevents water from entering the aft housing 104 where the electrical connector 108 mounts at the rear of the aft housing 104. As shown, the electrical connector 108 mounts to the aft housing 104 through a hole, and may be attached using a retaining hex nut 224 or other connecting component (not shown). Yet another O-ring, a housing sealing O-ring 226, wraps around a groove of the aft housing 104 and may be positioned between an internal wall of the forward housing 102 and an external wall of the aft housing 104.

Figure 3:
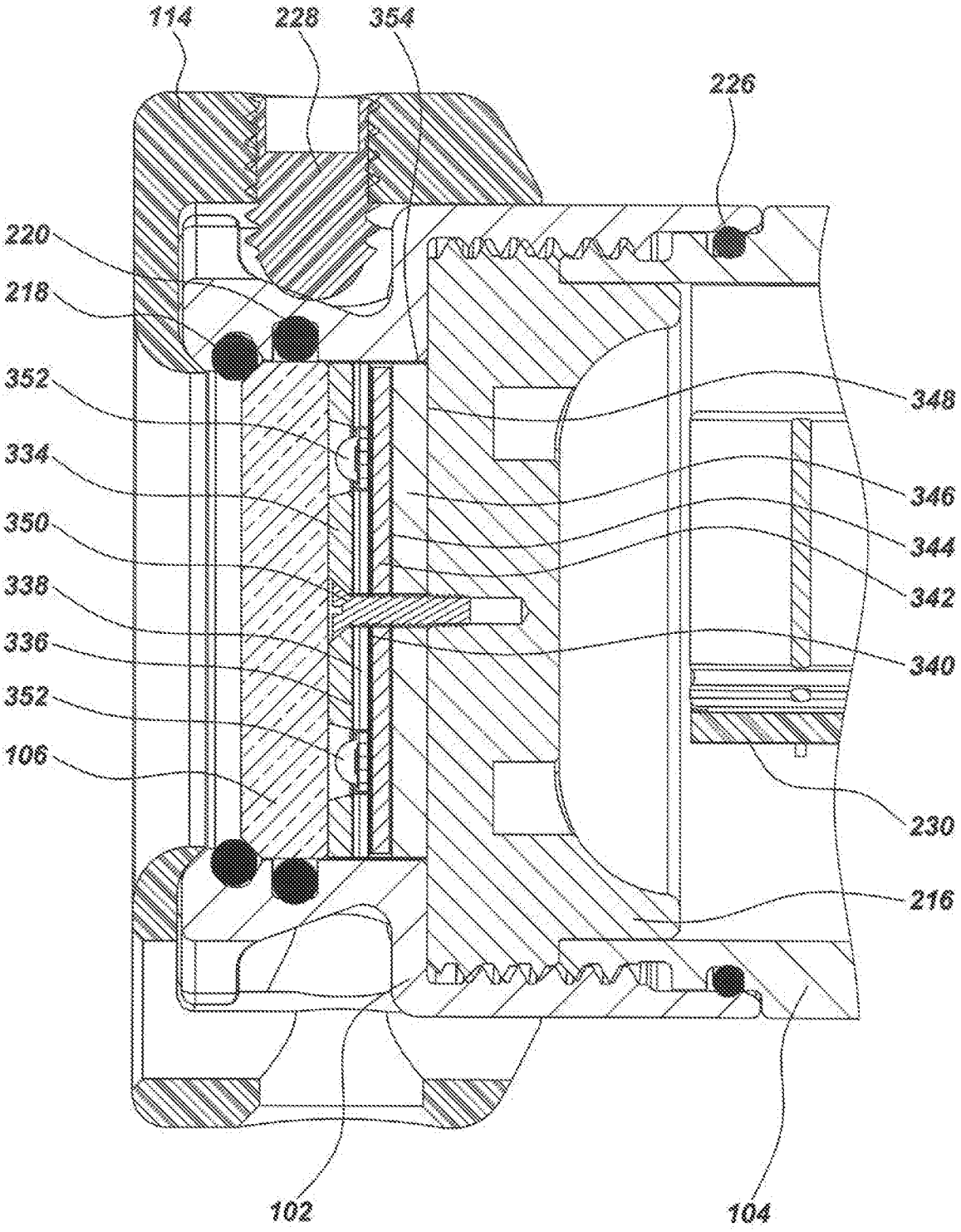
FIG. 3 is an enlarged fragmentary view of a stack subassembly of FIG. 2 illustrating the details of one embodiment of a multilayer stack.
Figure 4:
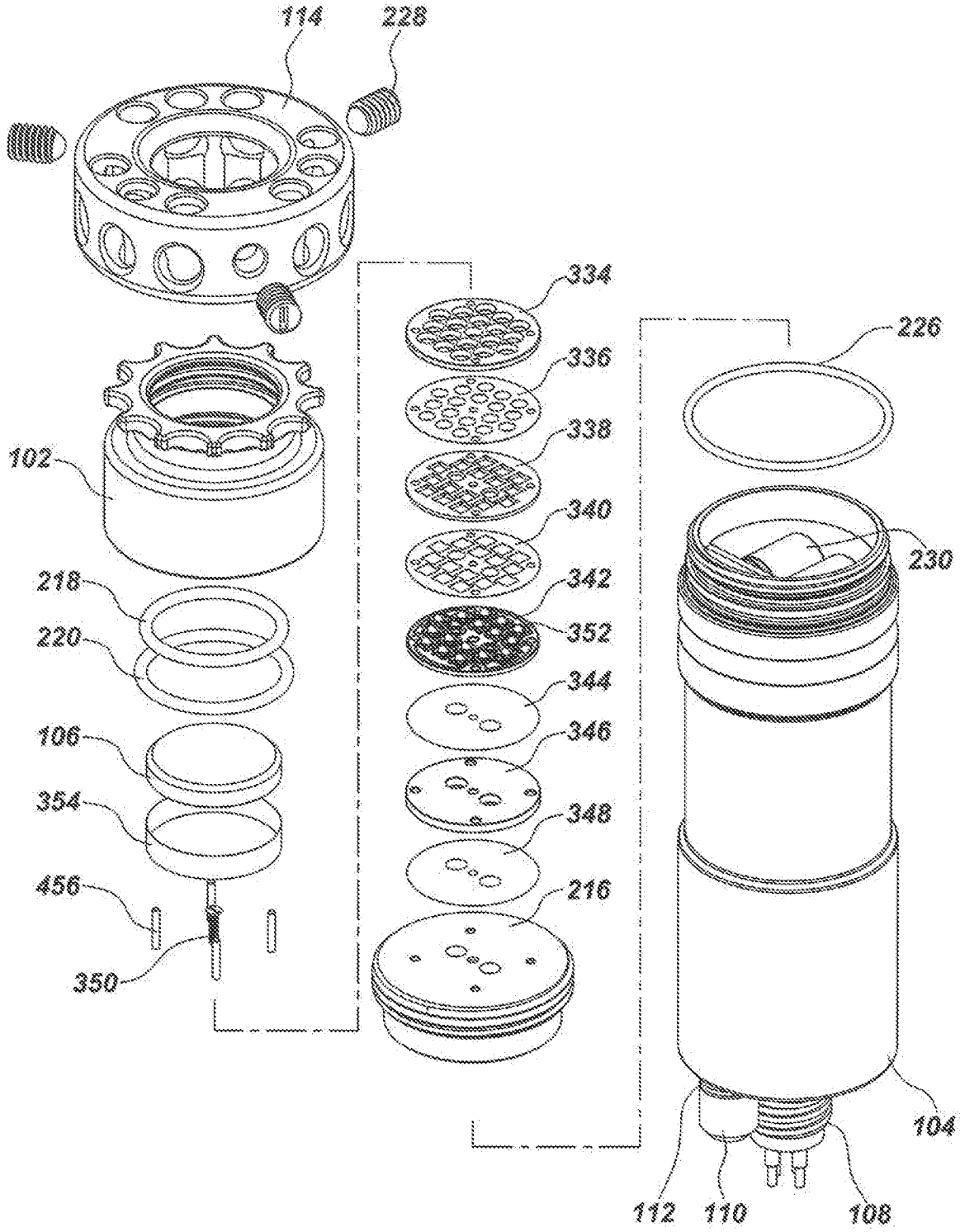
FIG. 4 depicts an isometric exploded view of the light head subassembly of FIG. 3.
Figure 22:
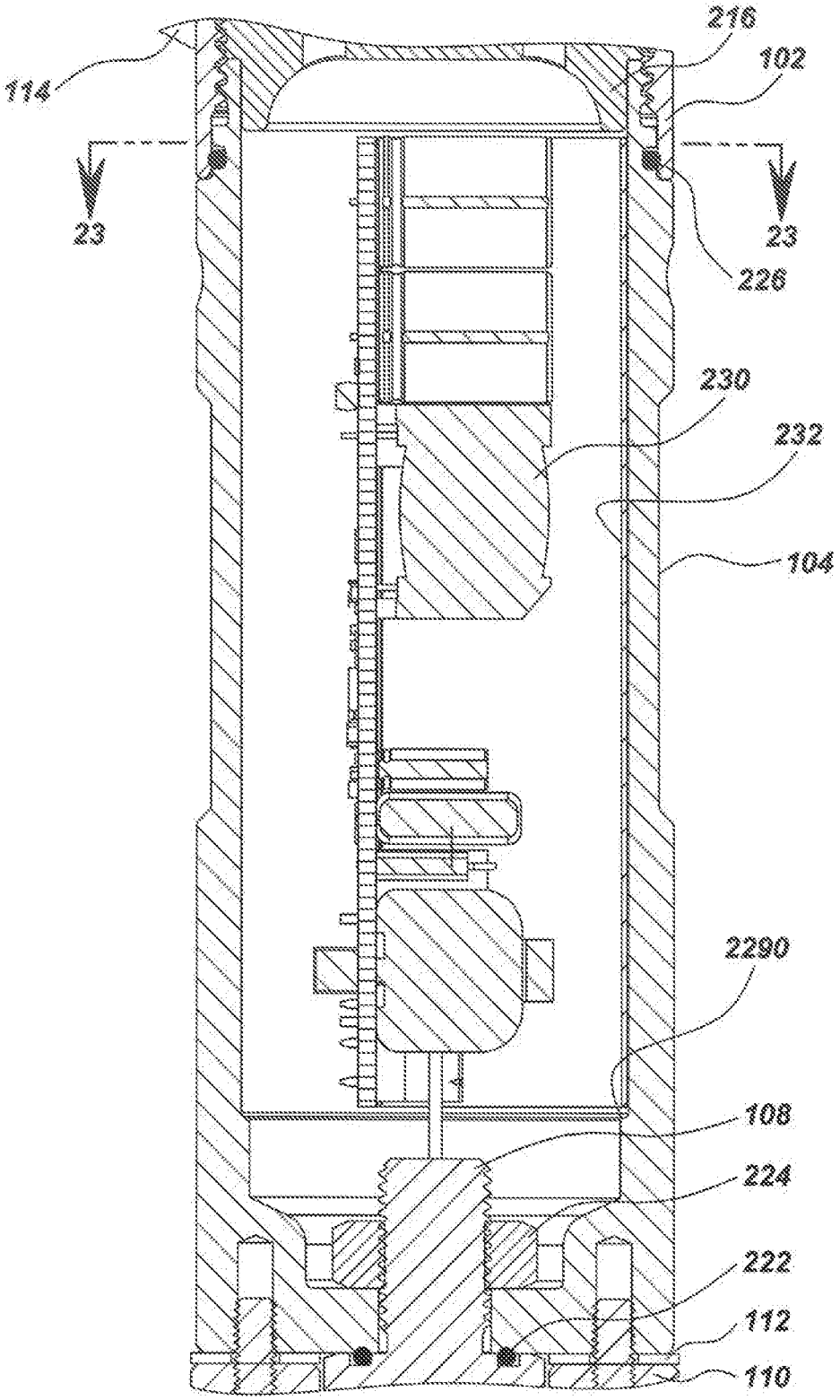
FIG. 22 is an enlarged fragmentary view of a lower housing subassembly of FIG. 2.
Figure 23:
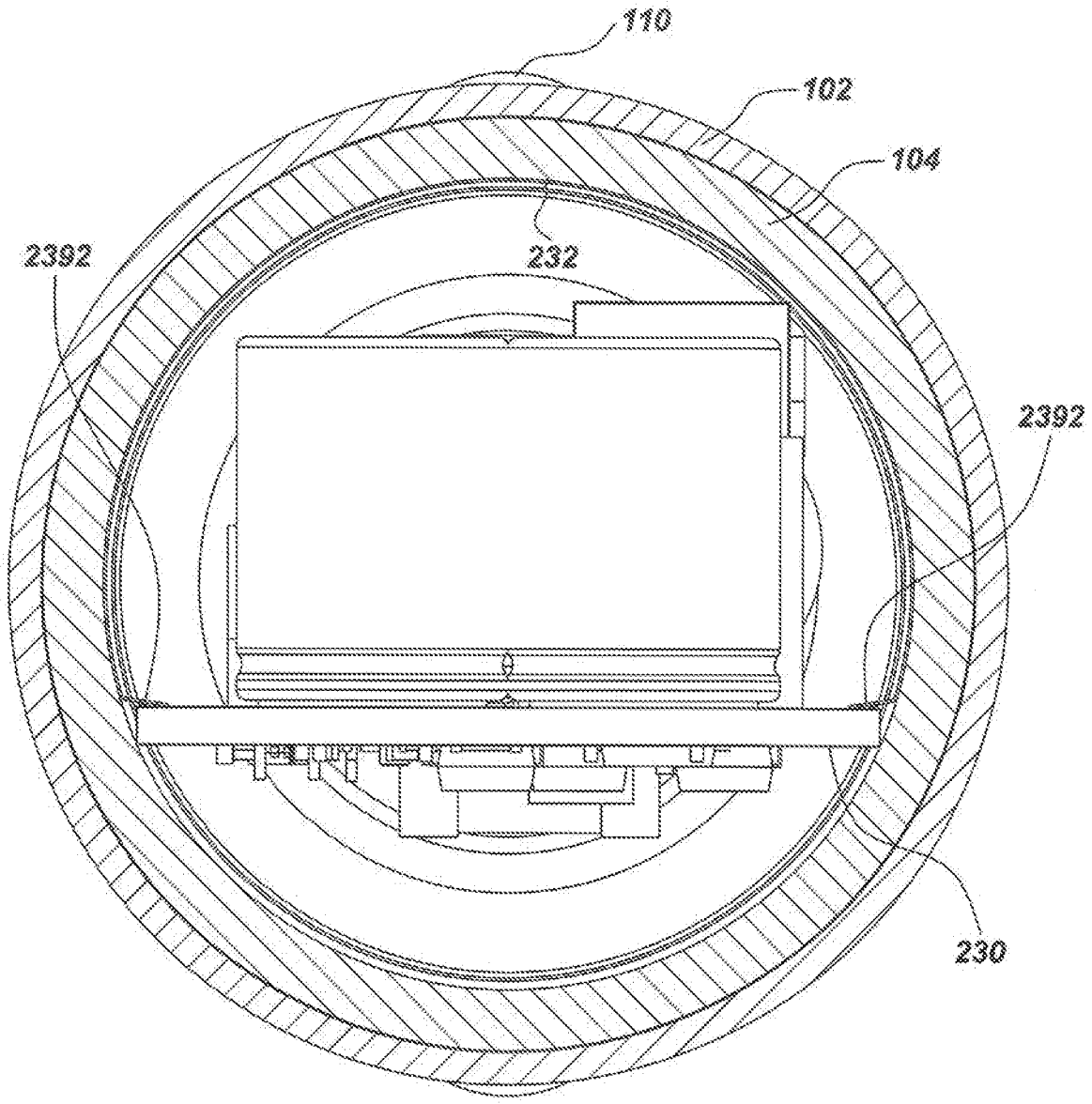
FIG. 23 provides another view of a portion of the lower housing subassembly of FIG. 22.
Figure 24:
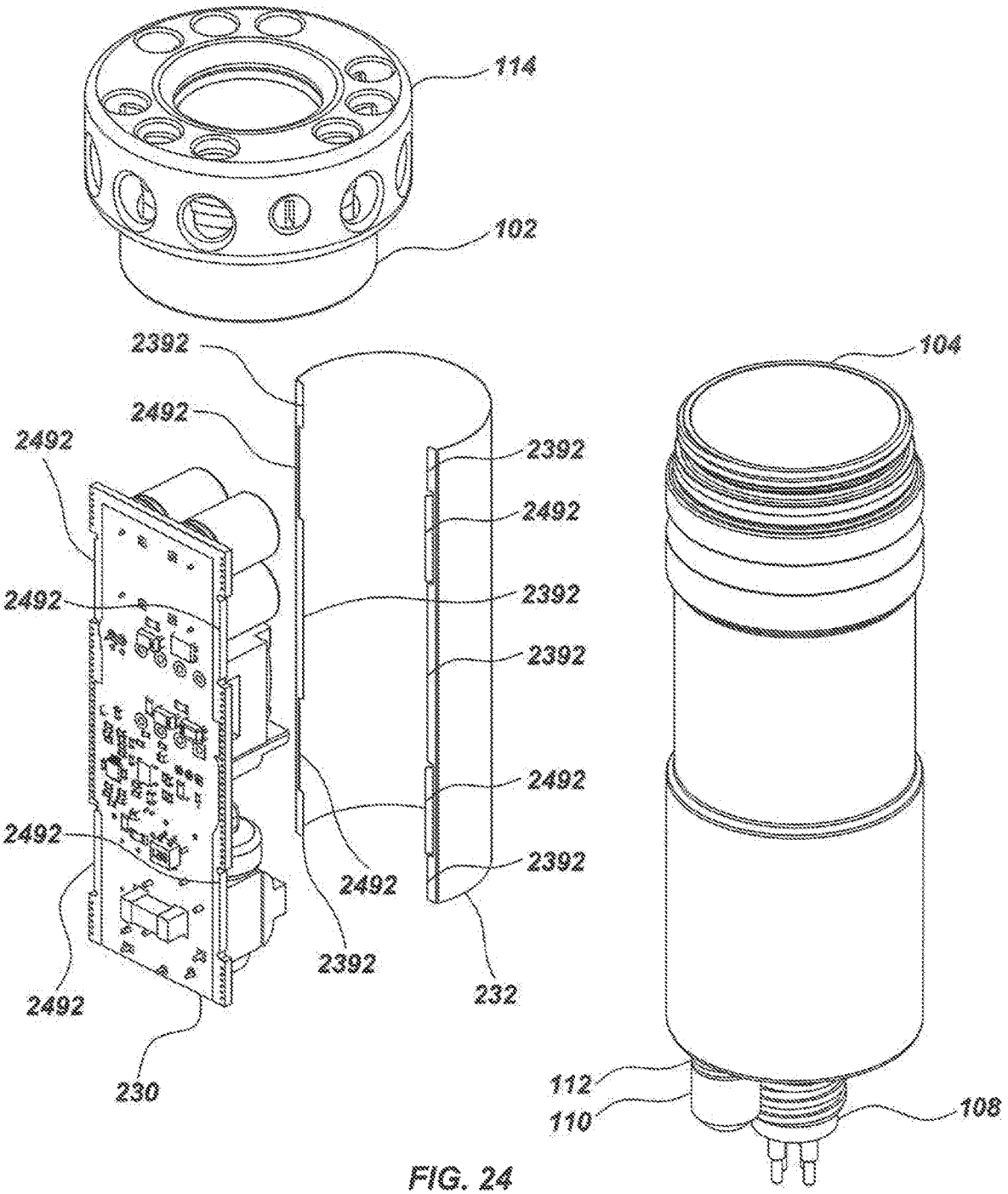
FIG. 24 depicts an isometric exploded view of the lower housing subassembly of FIG. 22 illustrating the details of one embodiment of a curved support for circuitry.

FIG. 2 also depicts an LED driver assembly that is positioned inside the aft housing 104. The LED driver assembly may include LED driver electronics 230 that are coupled to a flexed metal sheet that forms a driver mount 232. The spring force of the driver mount 232 operates on the driver electronics 230 to create a friction lock between the driver electronics 230 and an inside surface area of the aft housing 104. The driver mount 232 may be made from any material, including a thermally conductive material that carries thermal energy from the one or more components in the driver electronics 230 to an inner surface area of the aft housing 104. The spring force of the driver mount 232 lessens the effect, on the driver electronics 230, of certain vibrations or other mechanical movements of the aft housing 104 in relation to the driver electronics 230. FIGS. 22-24 illustrate further details of the driver electronics 230 and the driver mount 232. Turning now to FIG. 3 and FIG. 4. FIG. 3 provides an enlarged fragmentary view of the stack subassembly of FIG. 2. FIG. 4 depicts an isometric exploded view of the light head subassembly of FIG. 3. The stack subassembly, which may be inserted through one open end of the forward housing 102 and positioned behind the window 106, may include the pressure support structure 216, a window support structure 334, and an LED printed circuit board (PCB) 342 (e.g., a metal core PCB) populated with one or more LEDs 352. The pressure support structure 216 (and other variations in other embodiments) may contact the aft housing 104. Alternatively, a space may separate the pressure support structure 216 or its variations (including those variations using other structures for support and placement of the pressure support structure) and the aft housing 104. In this manner, the aft housing 104 does not support the pressure support structure 216 in relation to pressure exerted onto it by the external environment through the window and other stack element.

The stack may also include an insulation film (e.g., Ultem, PEEK, PET, PETG, Mylar, polyester, Kapton) on a supporting spacer surface 336 (e.g., anodized aluminum, coated aluminum, ceramic, circuit board material, fiberglass, FR4, P95), a supporting spacer 338 (e.g., anodized aluminum, coated aluminum, ceramic, circuit board material, fiberglass, FR4, P95), an insulation film 340 (e.g., Ultem, PEEK, PET, PETG, Mylar, polyester, Kapton) on LED PCB 342, a thermal coupling compound 344 on LED PCB 342, a thermally conductive spacer 346, and a thermal coupling compound on thermal spacer 348.

At least some of the pressure exerted on the window 106 from the external environment may be distributed through some or all layers of the stack sub-assembly, and carried by the pressure support structure 216, the forward housing 102 and/or the aft housing 104. An insulation film wrap 354 (e.g., Ultem, PEEK, PET, PETG, Mylar, polyester, Kapton) wraps around items 334-348.

FIGS. 3 and 4 illustrate a stack of layers that maximize contact surface area to better support the window 106 while carrying external pressure around the LEDs 352. Using this design provides a placement of the LEDs 352 near the window 106 that enables a wide beam of light. Volume around the LEDs 352 may be filled with atmospheric air, nitrogen, oxygen, or other gas(es), including inert gases like argon, neon, or helium. Alternatively, the volume around the LEDs 352 may provide a vacuum environment, or may include higher-than-ambient pressure (e.g., 2 to 3 atmospheres of nitrogen).

Various layers in the stack may be designed to accommodate certain features of other layers. For example, the window support structure 334, the insulation film on supporting spacer surface 336, the supporting spacer 338, and the insulation film 340 are shown to have a plurality of apertures through which the plurality of LEDs 352 may protrude.

Layers 334-348 and 216 are shown to accommodate a mechanical fastener 350 (e.g., a thermally-conductive threaded screw to provide additional pathways for excess heat), which may be inserted through the layers 334-348 and threaded into the pressure support structure 216 prior to insertion of layers 334-348 and 216 into the forward housing 102. The fastener 350 can optionally be metal, plastic, or another material. Layers 334-342, 346 and 216 are also shown to accommodate anti-rotation pins 456 that prevent each of those layers from spinning around the fastener 350. Alternative embodiments may include any number of fasteners and/or pins suitable for centering the layers 334-348 on the pressure support structure 216 in a manner that prevents those layers from unwanted movements and rotations.

As shown, an outer surface of the pressure support structure 216 may be threaded so the pressure support structure 216 and the other layers 334-348 fastened to it can be secured in the forward housing 102 by screwing the pressure support structure 216 into the forward housing 102. The coupling of threads formed on the pressure support structure 216 and complimentary threads formed on the forward housing 102 provide mechanical strength that enables the pressure support structure 216 to carry at least some or all of the pressure load applied to the window 106 by the external environment (e.g., pressure exerted by a marine environment), and further allows distribution of at least some or all of the load to the forward housing 102 and/or the aft housing 104. Screwing the pressure support structure 216 and the attached layers 334-348 into the forward housing 102 also provides a reliable and effective thermal contact between the forward flat surface of the pressure support structure 216 and the interior flat surface of the forward housing 102. This thermal contact directs thermal transfer from the pressure support structure 216 to the forward housing 102, which in turn directs thermal transfer to the external environment (e.g., the marine environment). Additional thermal transfer occurs from the pressure support structure 216 to aft housing 104 and certain components internal to aft housing 104.

Insertion of the window 106 into the forward housing, followed by insertion and tightening of the pressure support structure 216 and layers 334-348, compresses O-ring 118. Under increasing external pressure found at deeper ocean depths, the window 106 may be pressed inwards, the O-ring 118 decompresses while maintaining its seal, and pressure may be applied to some or all of the layers 334-348. As pressure may be applied, thermal energy transfer among various components may be improved as the layers in the stack maintain even greater contact with each other.

Some or all of the layers (e.g., the window support structure 334) and components may be made of high-compressive-strength material to resist the compressive force of ambient pressure at depth, such as, but not limited to, PEEK plastic, ULTEM, ceramic, or a common metal such as aluminum, steel, copper, or zinc. These layers may be machined, injection-molded or die cast. Conductive metals and plastics are desired because they assist with heat transfer away from the plurality of LEDs 352 and LED PCB 342. Additional materials may include beryllium-copper alloy, stainless steel, titanium alloy, cupronickel alloy, or any other metal or metal alloy, or a thermally conductive plastic. The window 106 may be made from clear plastic, borosilicate glass, sapphire, or other transparent materials. A sapphire window may be particularly desirable since its hardness will resist scratching and its high coefficient of heat transfer will help dissipate heat from the plurality of LEDs 352. A sapphire window may be also strong in tension compared to glass (e.g., typically about ten times stronger in comparison), and similar to glass in compressive strength.

Figure 5:
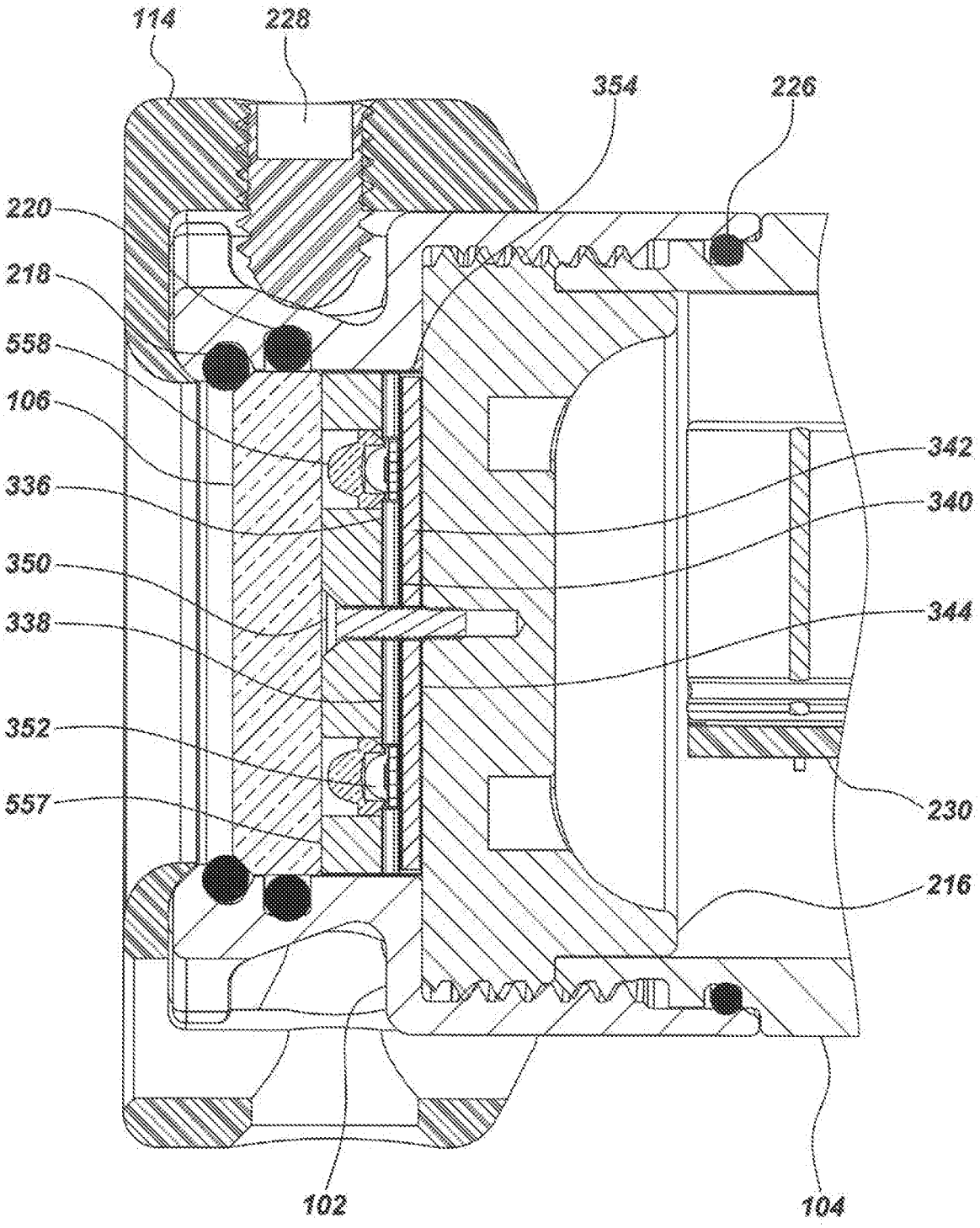
FIG. 5 depicts an enlarged section view of an alternate embodiment of the present disclosure incorporating more spacing between a window and LEDs, allowing the use of internal reflectors to produce a narrow beam of light.
Figure 6:
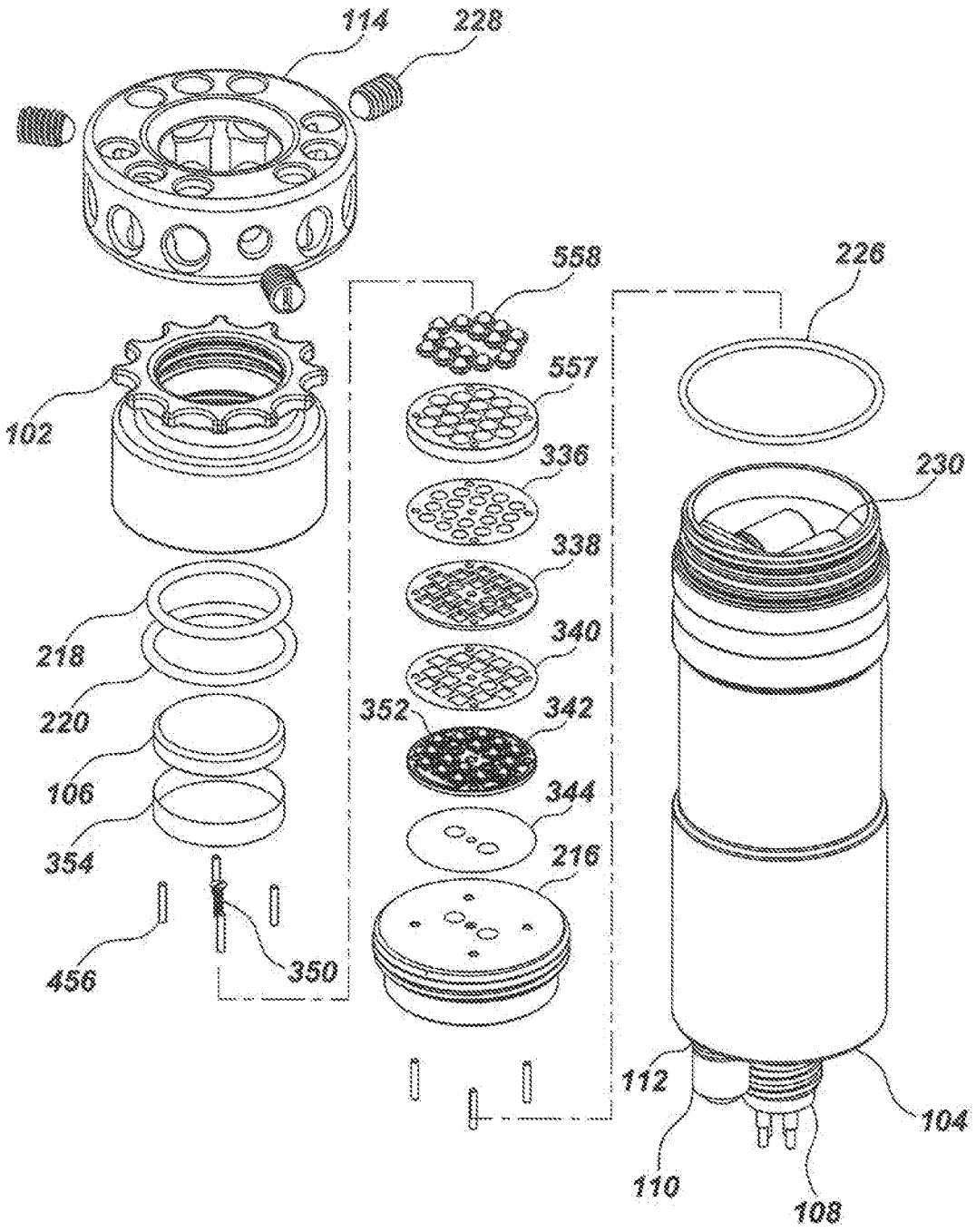
FIG. 6 depicts an isometric exploded view of the light head subassembly of FIG. 5.

Attention is now drawn to FIG. 5 and FIG. 6. FIG. 5 provides an enlarged section view of an alternate embodiment of the present disclosure incorporating more spacing between a window and LEDs, which allows for the use of internal reflectors to produce a narrow beam of light. FIG. 6 depicts an isometric exploded view of the light head subassembly of FIG. 5.

The stack of layers in FIGS. 5 and 6 maximize contact surface area to better support the window 106 while carrying external pressure around the LEDs 352. As shown, the window support structure 557 may be thicker than the window support structure 334 of FIGS. 3 and 4. To make up for the increased thickness of the window support structure 557, the thermally conductive spacer 346 has been omitted from the design shown in FIGS. 5 and 6. The thicker window support structure 557 places the LEDs 352 away from the window 106, allowing the use of internal reflectors 557 (e.g., Catadioptric reflectors) to produce a narrow beam of light.

Figure 7:
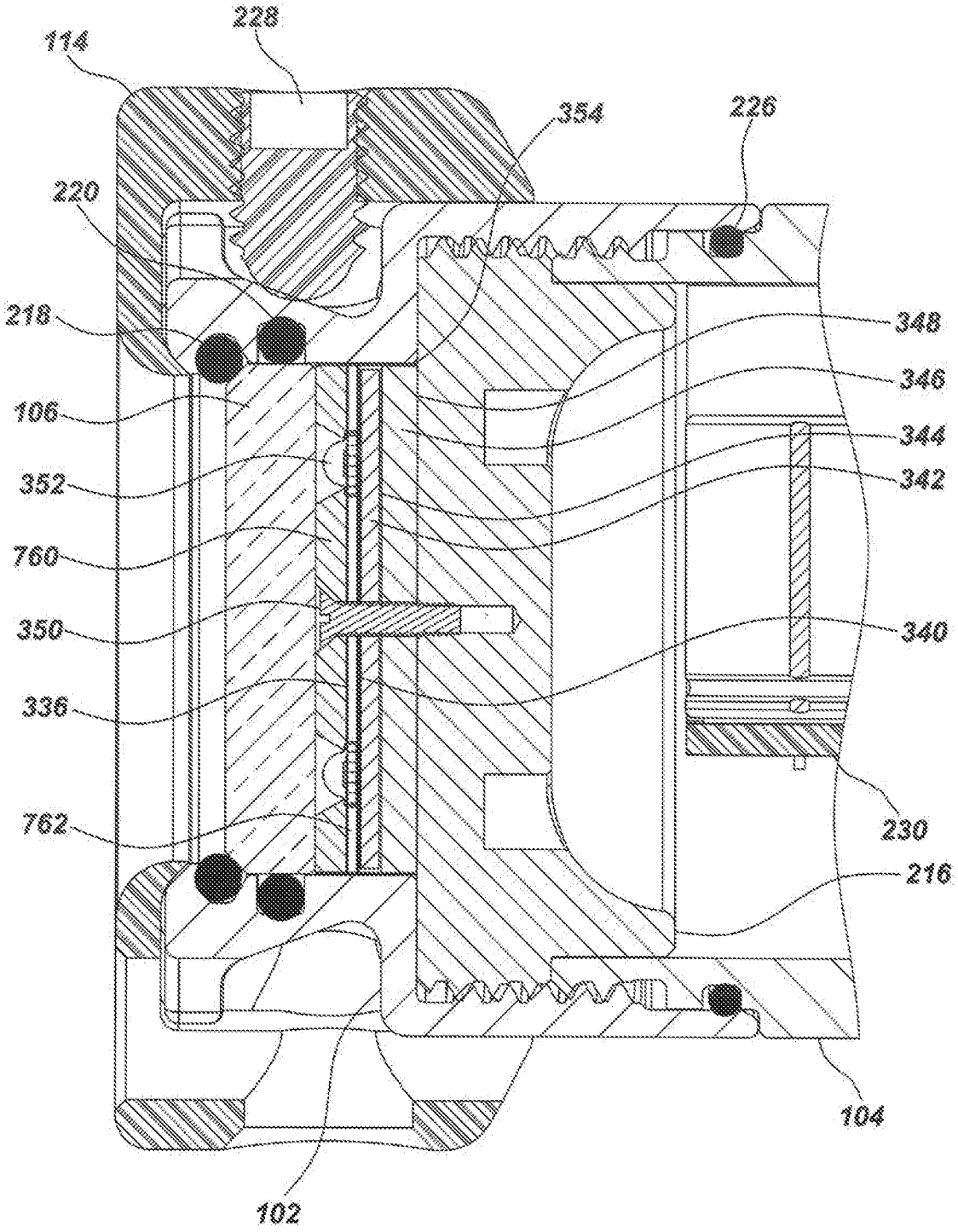
FIG. 7 depicts an enlarged section view of an alternate embodiment of the present disclosure incorporating a LED package that bears a portion of external pressure exerted on a window.
Figure 8:
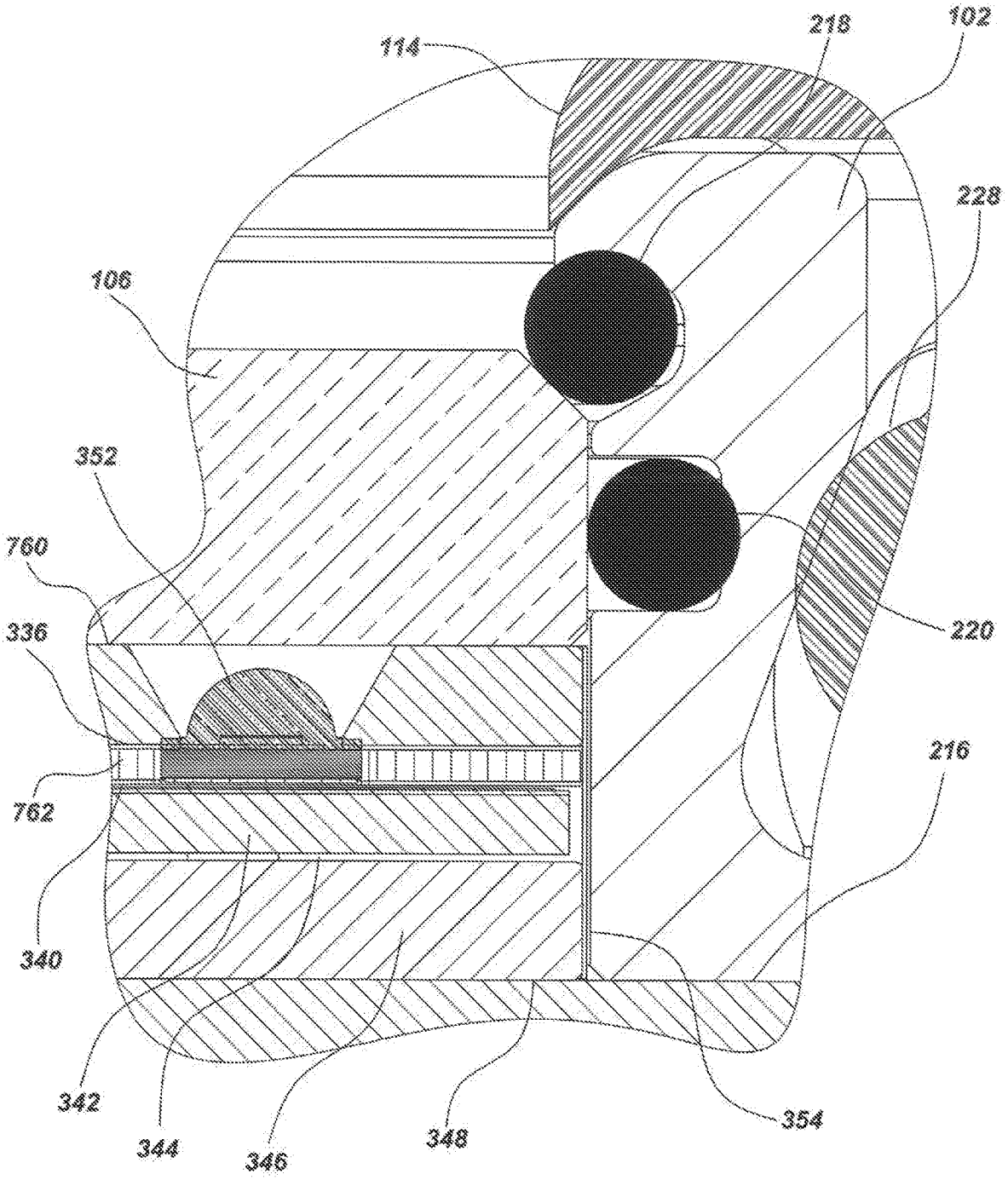
FIG. 8 is an enlarged fragmentary section view of a portion of FIG. 7.

Attention is now drawn to FIG. 7 and FIG. 8. FIG. 7 provides an enlarged section view of an alternate embodiment of the present disclosure incorporating an LED package that bears a portion of external pressure exerted on a window. FIG. 8 provides an enlarged section view of the alternative embodiment depicted in FIG. 7. As shown in FIGS. 7 and 8, a supporting spacer 762 (e.g., anodized aluminum, coated aluminum, ceramic, circuit board material, fiberglass, FR4, P95) may be thinner that the corresponding spacer 338 in FIGS. 3-4, and a window support structure 760 may be thicker that the corresponding window support structure 334 in FIGS. 3-4 to account for the thinner spacer 762. The thinner spacer 762 allows the thicker window support structure 760 to rest directly on a portion of the LEDs 352 around the LED domes, thereby distributing pressure onto the LEDs 352

Figure 9:
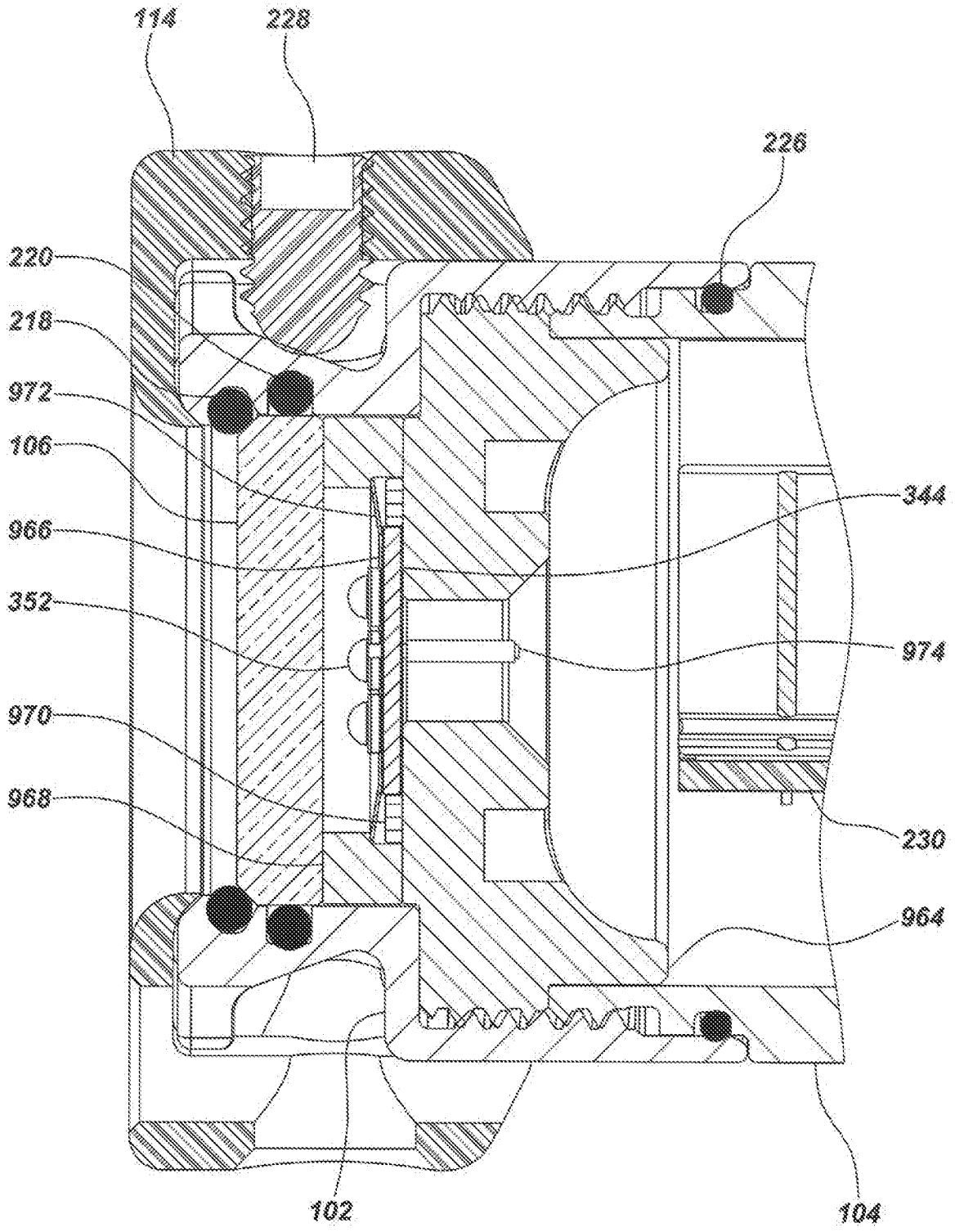
FIG. 9 depicts an enlarged section view of an alternate embodiment of the present disclosure incorporating a spring, and a window support structure that encircles a compact cluster of LEDs.
Figure 10:
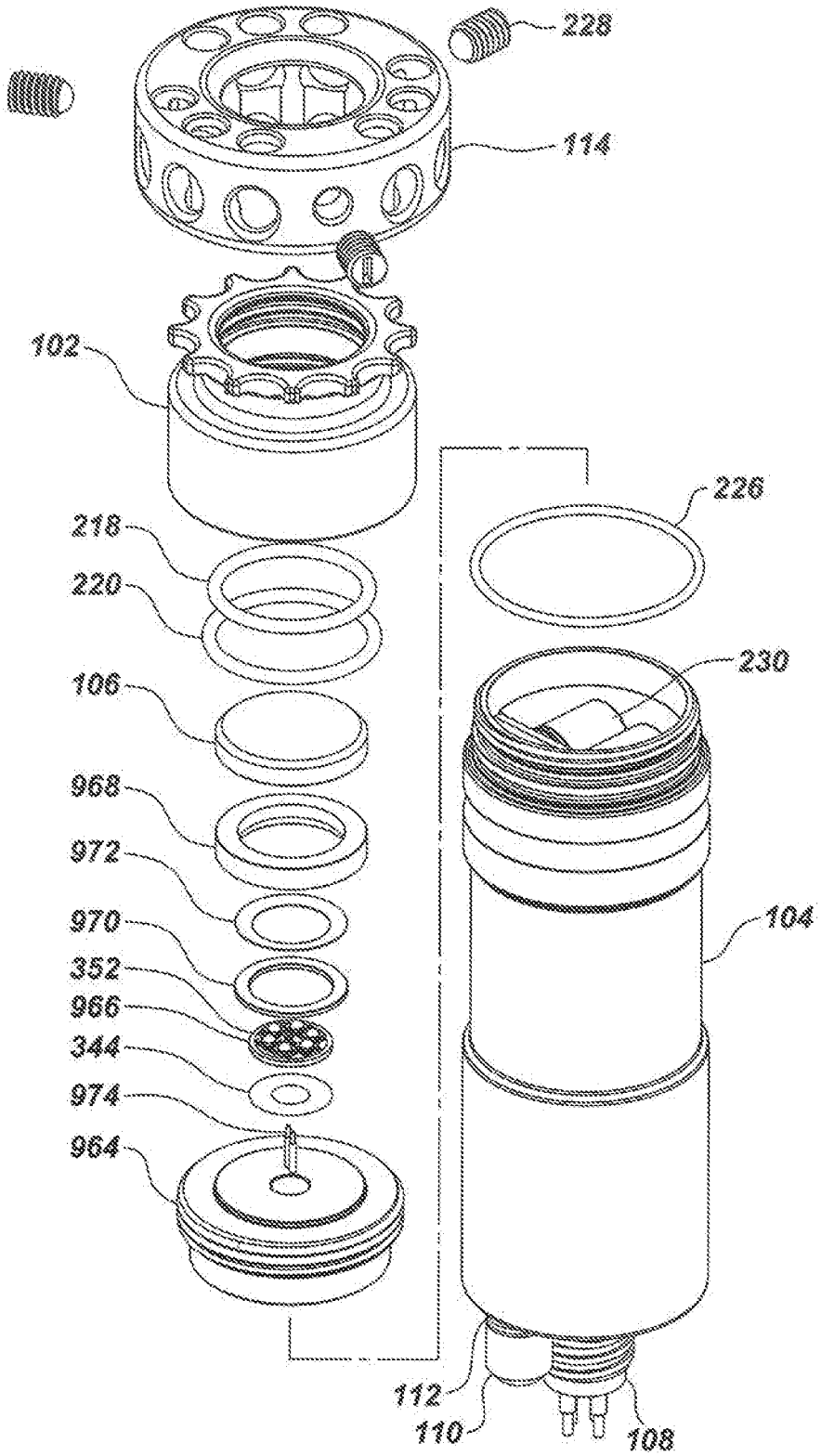
FIG. 10 depicts an isometric exploded view of the light head subassembly of FIG. 9.

Attention is now drawn to FIG. 9 and FIG. 10. FIG. 9 provides an enlarged section view of an alternate embodiment of the present disclosure incorporating a spring, and a window support structure that encircles a compact cluster of LEDs. FIG. 10 depicts an isometric exploded view of the light head subassembly of FIG. 9. FIGS. 9 and 10 include LED PCB 966 with six, clustered LEDs 352 that offer unique beam-forming properties. A ring-shaped, window support structure 968 encircles the LED PCB 966 and LEDs 352 while bearing pressure applied by the window 106. This ring-shaped, window support structure 968 enables certain clusters or other patterns of LEDs 352. A centering ring 970 centers the LED PCB 966 inside the encircling window support structure 968. This centering ring 970 offers an alternative structure other than fastener 350 for centering the LED PCB 966 and LEDs 352. The LED PCB 966 maintains a fixed position after a spring 972 (e.g., a Belleville spring) may be engaged. The spring 972 may be configured to position the LED PCB 966 so both the spring 972 and the LED PCB 966 maintain desirable thermal connections with other components of the luminaire (e.g., the housing 102, the window 106, a pressure support structure 964). The pressure support structure 964 may be shown to have an elevated step with a diameter equal to or similar to the diameter of the window 106 and the window support structure 968. This step ensures that the spring 972 engages when the pressure support structure 964 may be screwed into the forward housing 102. The step could be replaced by a spacer (not shown). A set of wires 974 are also depicted in FIGS. 9 and 10. These wires deliver power to the LEDs 352.

Figure 11:
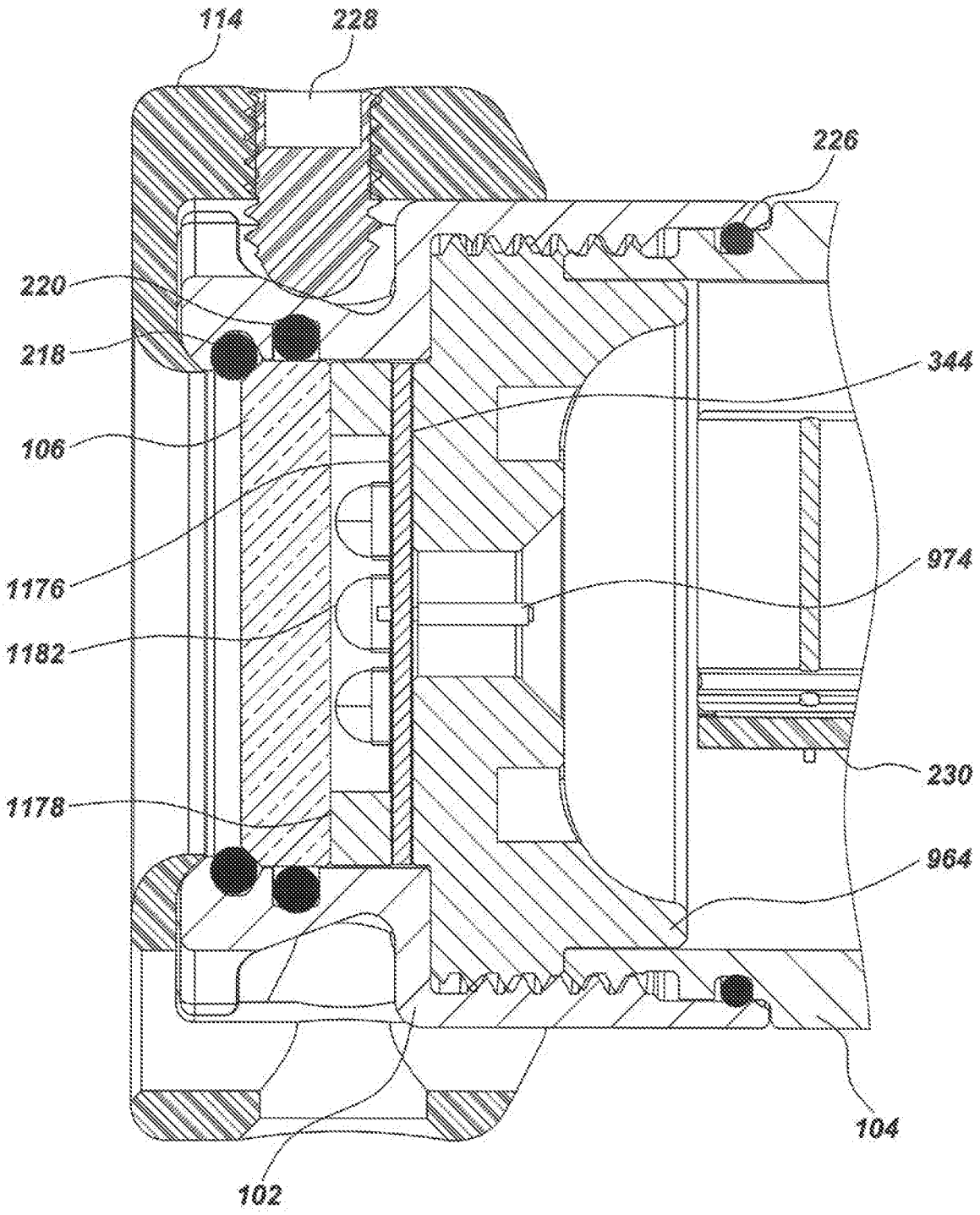
FIG. 11 depicts an enlarged section view of an alternate embodiment of the present disclosure incorporating a window support structure that encircles a compact cluster of LEDs.
Figure 12:
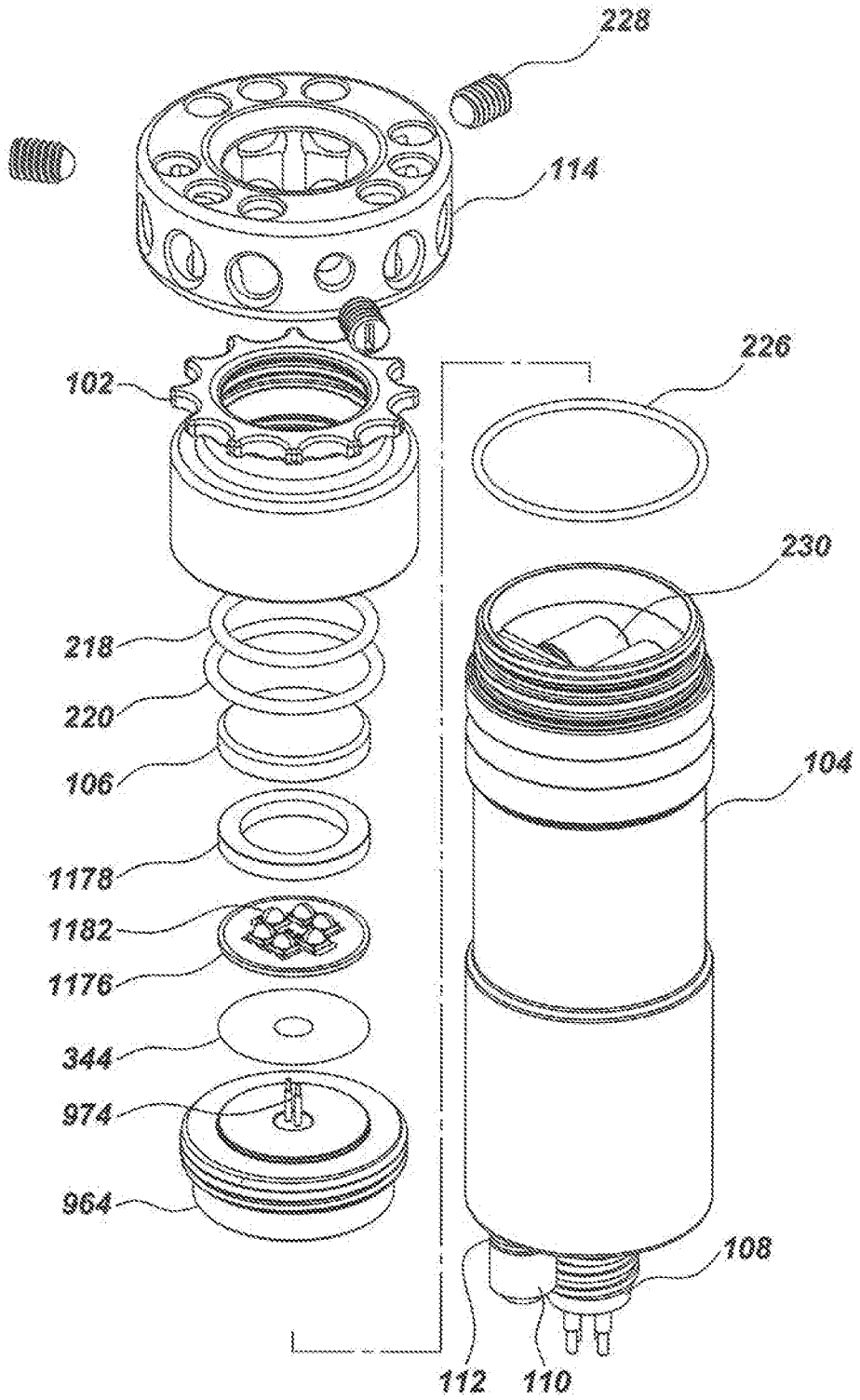
FIG. 12 depicts an isometric exploded view of the light head subassembly of FIG. 11.

Attention is now drawn to FIG. 11 and FIG. 12. FIG. 11 provides an enlarged section view of an alternate embodiment of the present disclosure incorporating a window support structure that encircles a compact cluster of LEDs. FIG. 12 depicts an isometric exploded view of the light head subassembly of FIG. 11. As shown in FIGS. 11 and 12, a larger LED PCB 1176 (compared to the LED PCB 966) may be populated by taller LEDs 1182 (compared to LEDs 352). A thinner, ring-shaped, window support structure 1178 (compared to window support structure 968) encircles the LEDs 1182, and may be positioned on top of the LED PCB 1176. Pressure delivered by the window 106 to the window support structure 1178 may be carried and transferred to the LED PCB 1176, which carries and transfers the pressure to the pressure support structure 964.

Figure 13:
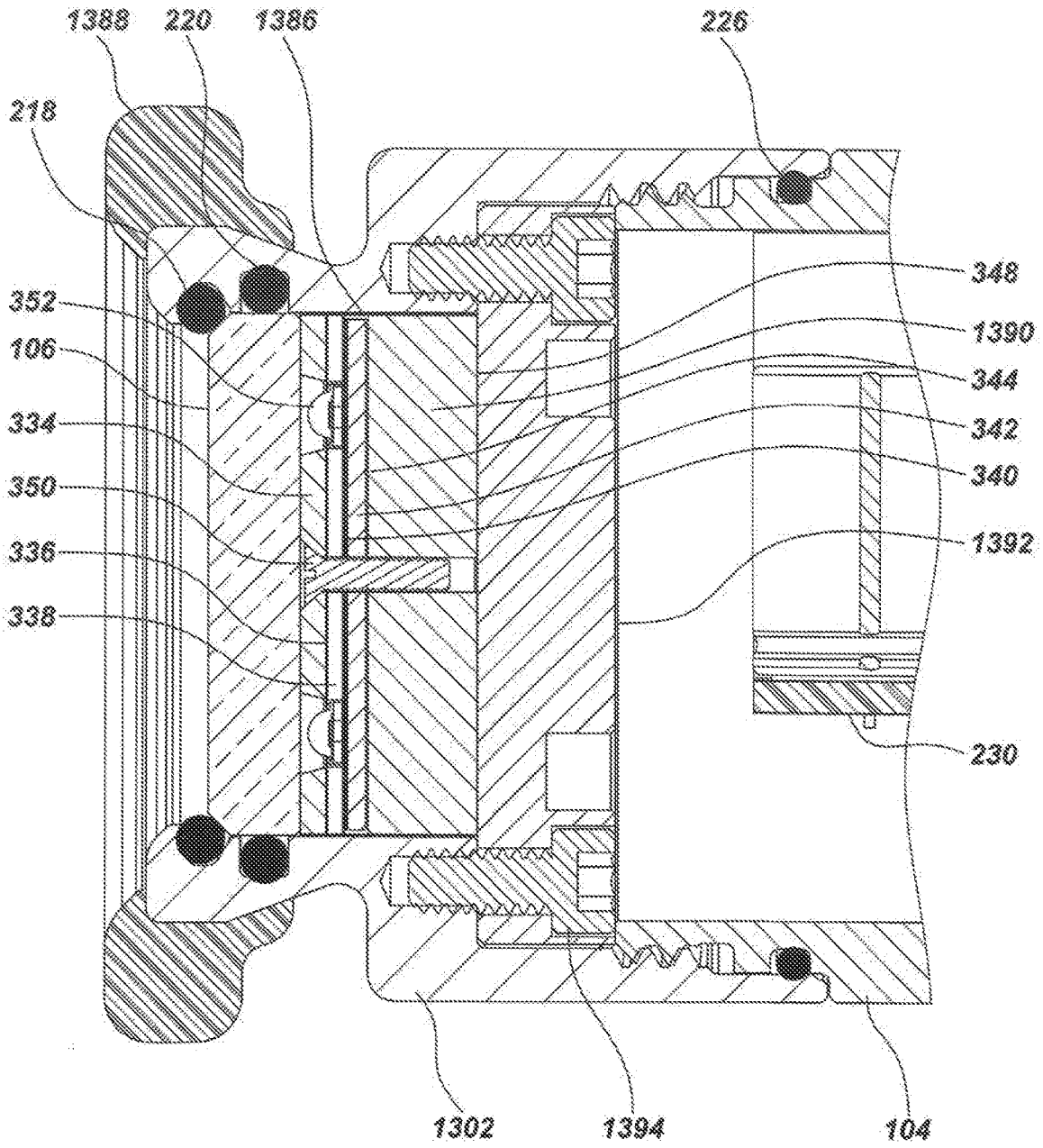
FIG. 13 depicts an enlarged section view of an alternate embodiment of the present disclosure incorporating a pressure support structure that is bolted to a forward housing.
Figure 14:
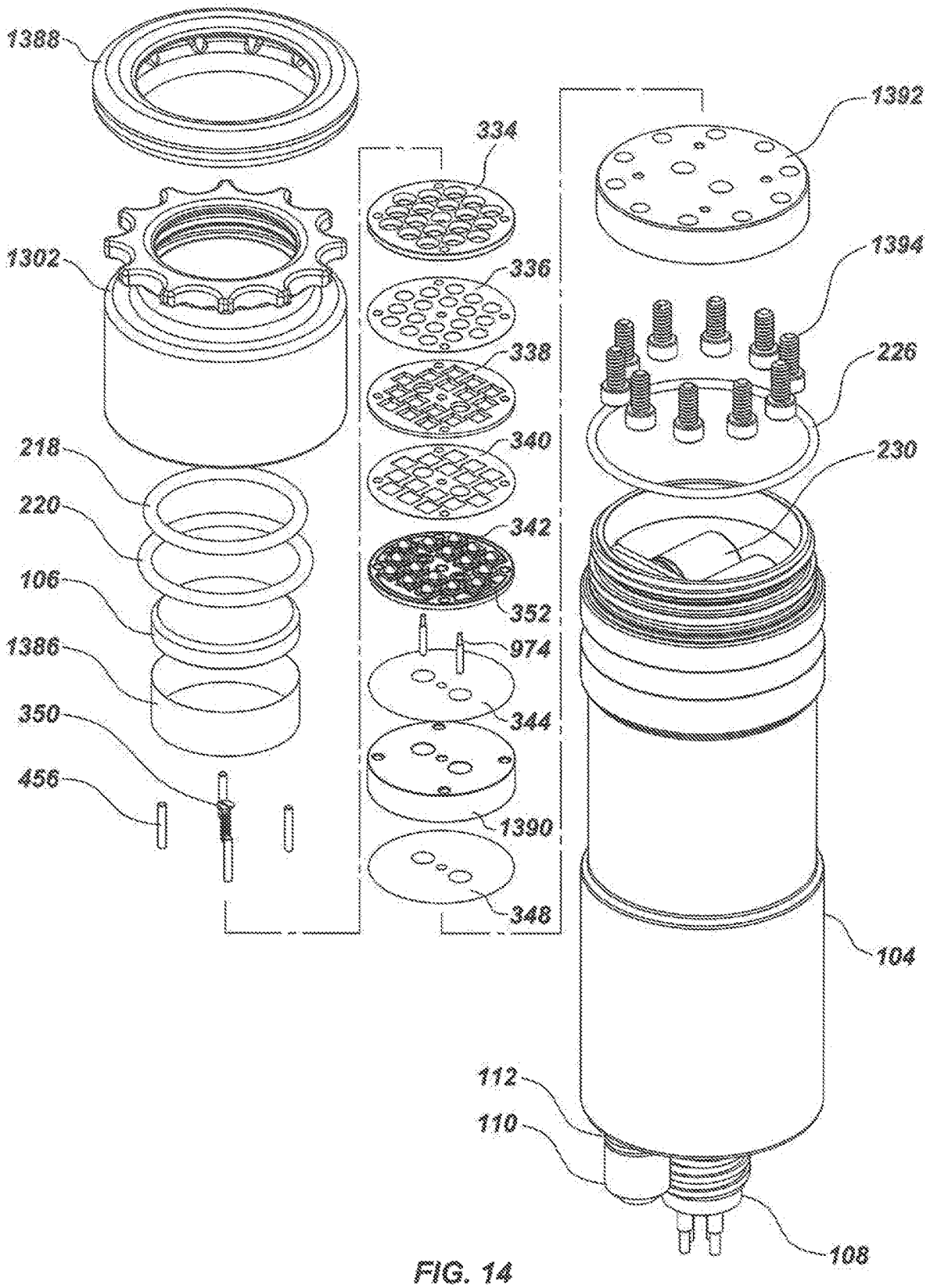
FIG. 14 depicts an isometric exploded view of the light head subassembly of FIG. 13.

Attention is now drawn to FIG. 13 and FIG. 14. FIG. 13 provides an enlarged section view of an alternate embodiment of the present disclosure incorporating a pressure support structure that may be bolted to a forward housing. FIG. 14 depicts an isometric exploded view of the light head subassembly of FIG. 13. As shown, FIG. 13 includes a forward pressure housing 1302 with one or more threaded holes to receive one or more respective pressure support structure fasteners 1394. The pressure support structure fasteners 1394 are inserted through respective holes of a pressure support structure 1392 and coupled to the threaded holes of the forward housing 1302, thereby securing the pressure support structure 1392 in a fixed position relative to the forward housing 1302. When secured, the pressure support structure 1392 operates to hold several stack components in place within the forward housing 1302. These components, which are fastened together by the fastener 350, include the window support structure 334, the insulation film on supporting spacer surface 336, the supporting spacer 338, the insulation film 340, the LED PCB 342, the thermal coupling compound 344, and a conductive spacer 1390.

Optionally, some, none or all of the pressure exerted on the window 106 from the external environment may be transferred through various layers of components and carried on the pressure support structure 1392, the fasteners 1394, the forward housing 1302, and/or the aft housing 104. When fastened to the forward housing 1302, the pressure support structure 1392 provides a reliable and effective thermal contact between several, flat surfaces of the pressure support structure 1392 and several, corresponding interior surfaces of the forward housing 1302. An insulation film wrap 1386 (e.g., Ultem, PEEK, PET, PETG, Mylar, polyester, Kapton) may be also shown to circumscribe several of the components. Although not shown, a space may be designed between the aft housing 104 and the pressure support structure 1392.

The forward housing 1302 differs from the forward housing 102 of FIGS. 3-4 by including the threaded holes described above and depicted in FIG. 13. In addition, the forward housing 1302 omits a portion of the internal, annular threads shown on the forward housing 102 in FIG. 3 that were disposed to couple to corresponding threads on the pressure support structure 216 of FIG. 3. FIGS. 13 and 14 also depict a molded crash guard 1388 that attaches to the forward housing 1302 (e.g., the crash guard 1388 may be an elastomeric "rubber boot" style guard that is stretched around the forward housing 102 during installation).

Figure 15:
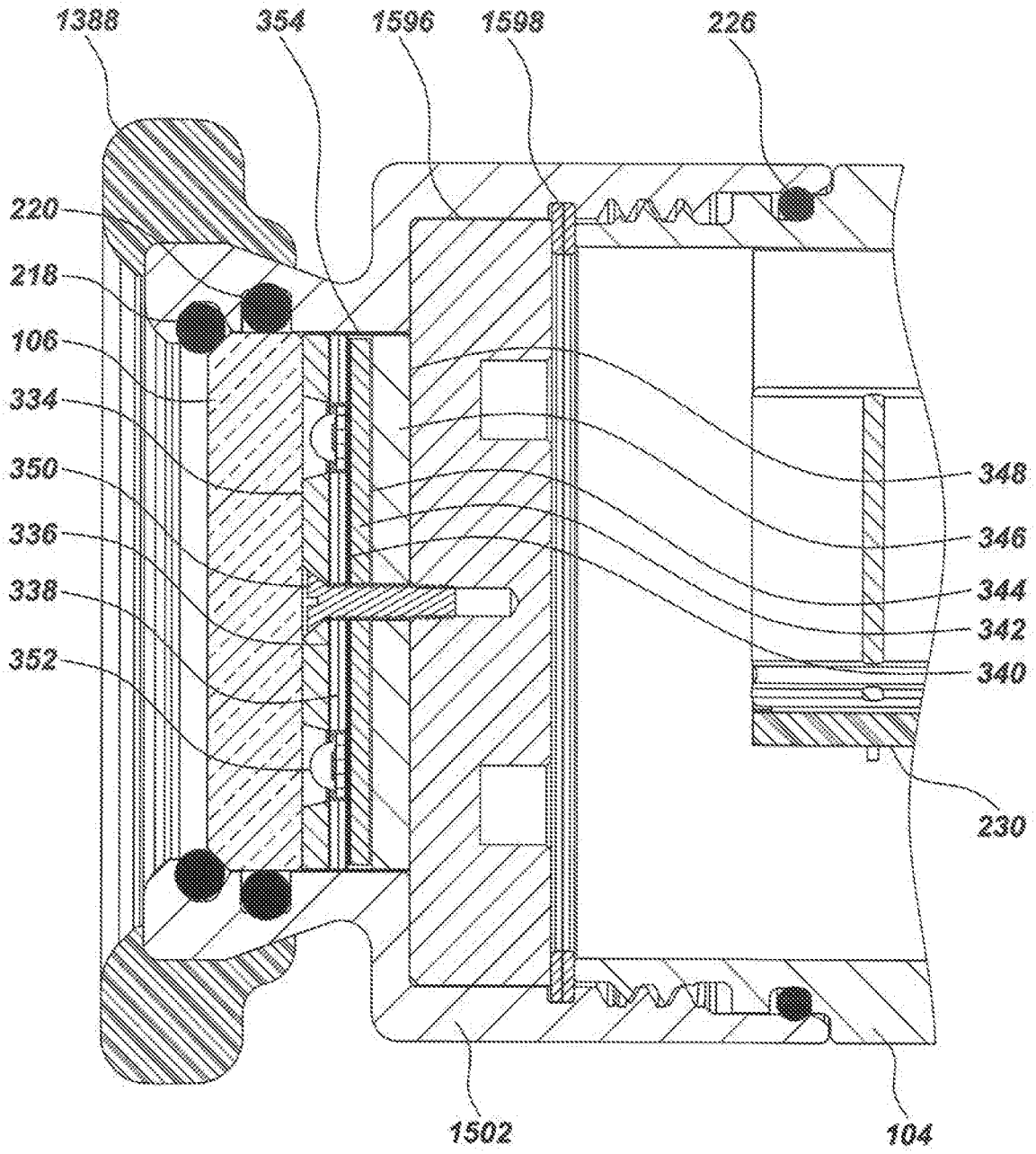
FIG. 15 depicts an enlarged section view of an alternate embodiment of the present disclosure incorporating a pressure support structure that is held in place by a retaining ring.
Figure 16:
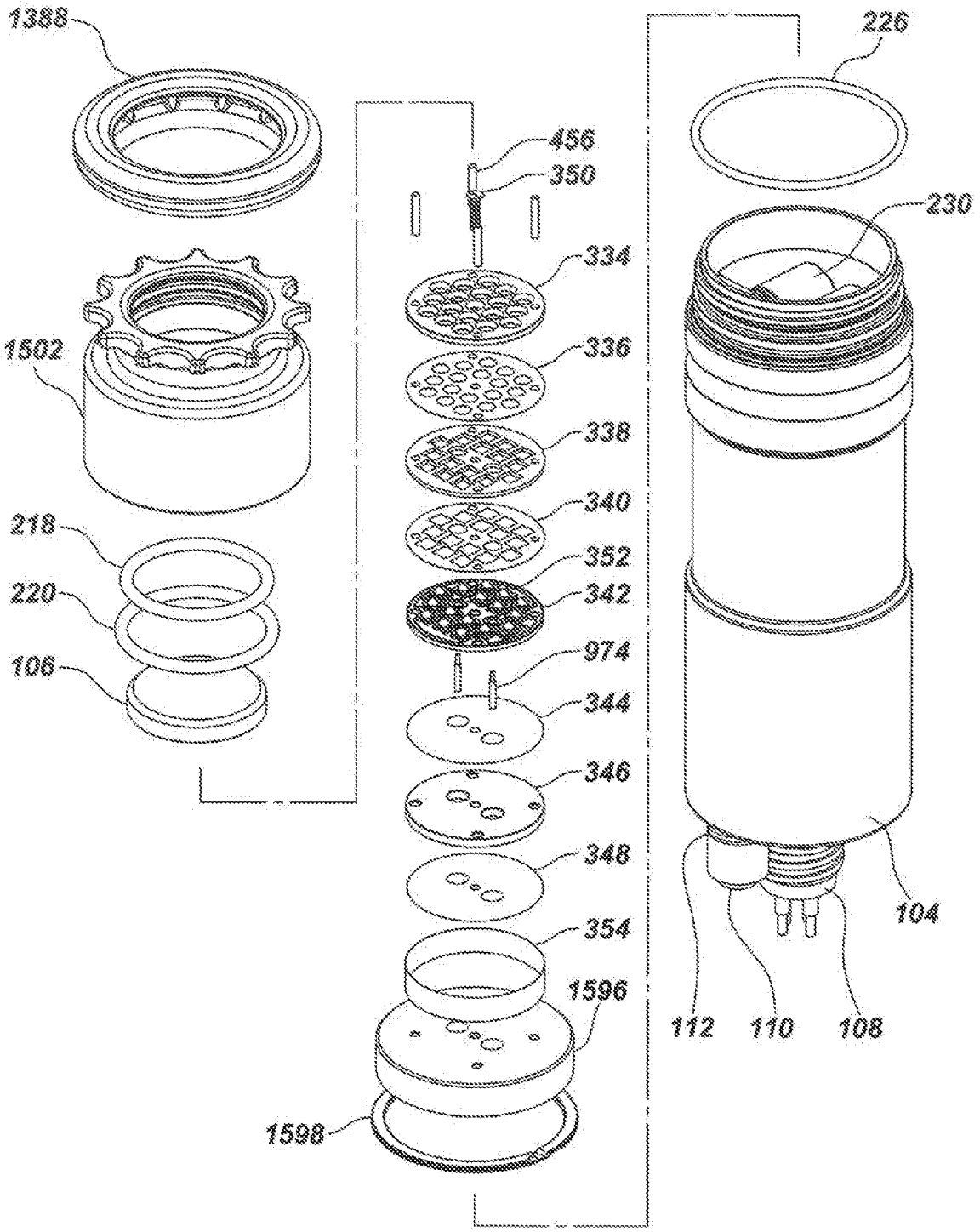
FIG. 16 depicts an isometric exploded view of the light head subassembly of FIG. 15.

Attention is now drawn to FIG. 15 and FIG. 16. FIG. 15 provides an enlarged section view of an alternate embodiment of the present disclosure incorporating a pressure support structure that may be held in place by a retaining ring. FIG. 16 depicts an isometric exploded view of the light head subassembly of FIG. 15. As shown, a pressure support structure 1596 may be inserted inside a forward pressure housing 1502, and held in place by a retaining ring 1598. The retaining ring 1598 may be snapped into a groove of the forward housing 1502, screwed into place (not shown) or otherwise coupled to an internal, annular wall of the first housing 1502. When held in place, the pressure support structure 1596 operates to secure several stack components first shown in FIG. 3 within the forward housing 1502.

Optionally, some, none or all of the pressure exerted on the window 106 from the external environment may be transferred through various layers of components and carried on the pressure support structure 1596, the retaining ring 1598, the forward housing 1502 and/or the aft housing 104. When fastened to the forward housing 1502, the pressure support structure 1596 provides a reliable and effective thermal contact between several, flat surfaces of the pressure support structure 1596 and several, corresponding interior surfaces of the forward housing 1502. Although not shown, a space may be designed between the aft housing 104 and the retaining ring 1598.

The forward housing 1502 differs from the forward housing 102 of FIGS. 3-4 by omitting a portion of the internal, annular threads shown on the forward housing 102 in FIG. 3 that were disposed to couple to corresponding threads on the pressure support structure 216 of FIG. 3.

Figure 17:
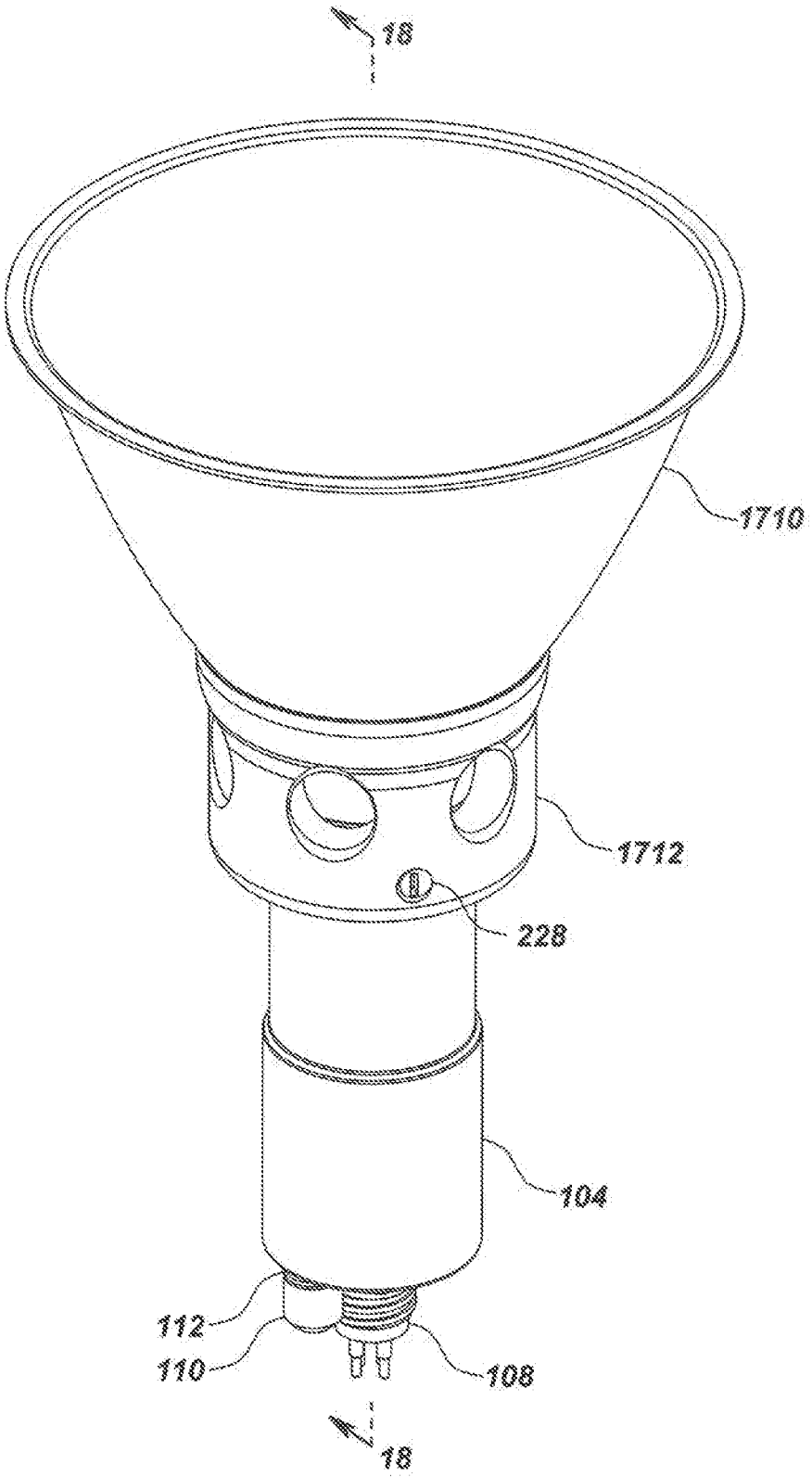
FIG. 17 depicts an isometric view of the exterior of an embodiment of the present disclosure in the form of an underwater multilayer LED light fixture.
Figure 18:
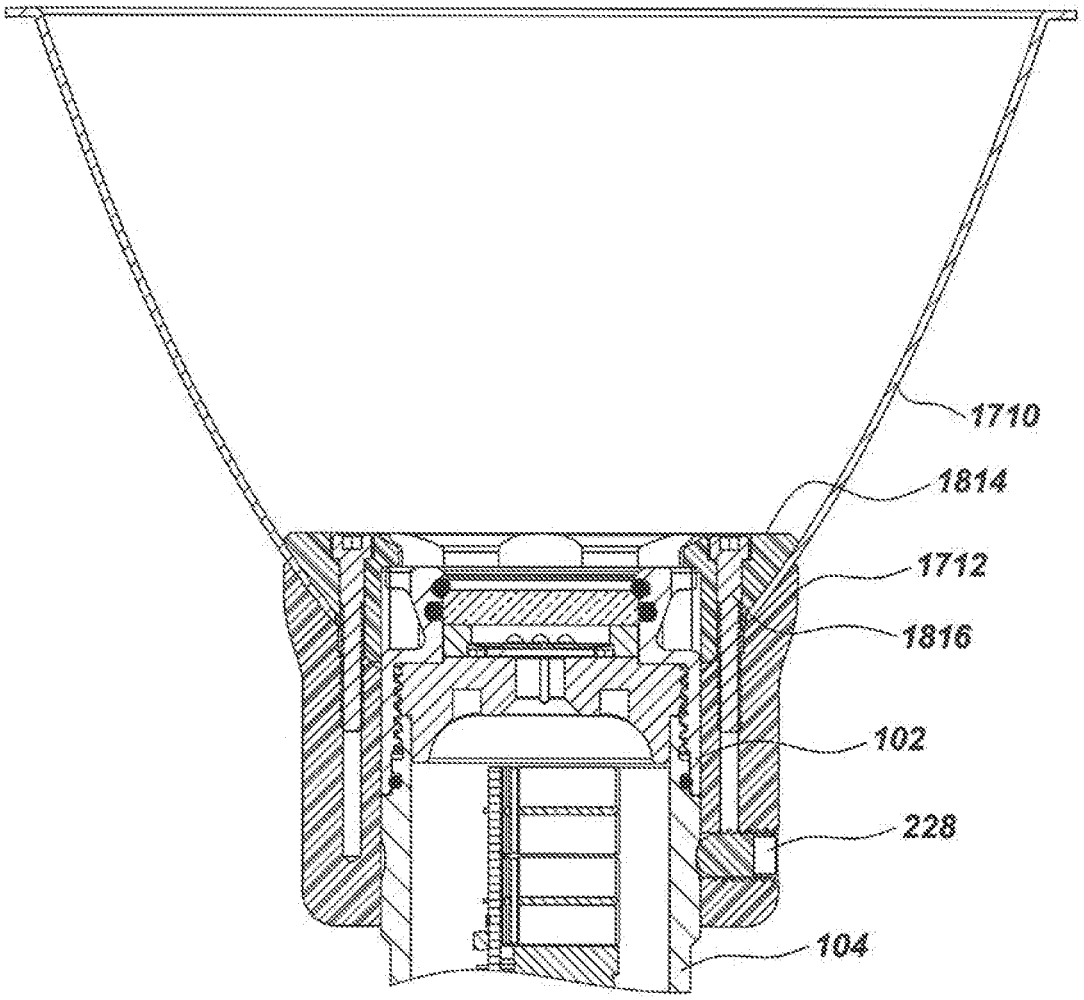
FIG. 18 depicts an enlarged fragmentary view of a light head subassembly of FIG. 17 illustrating the details of one embodiment of a multilayer stack.
Figure 19:
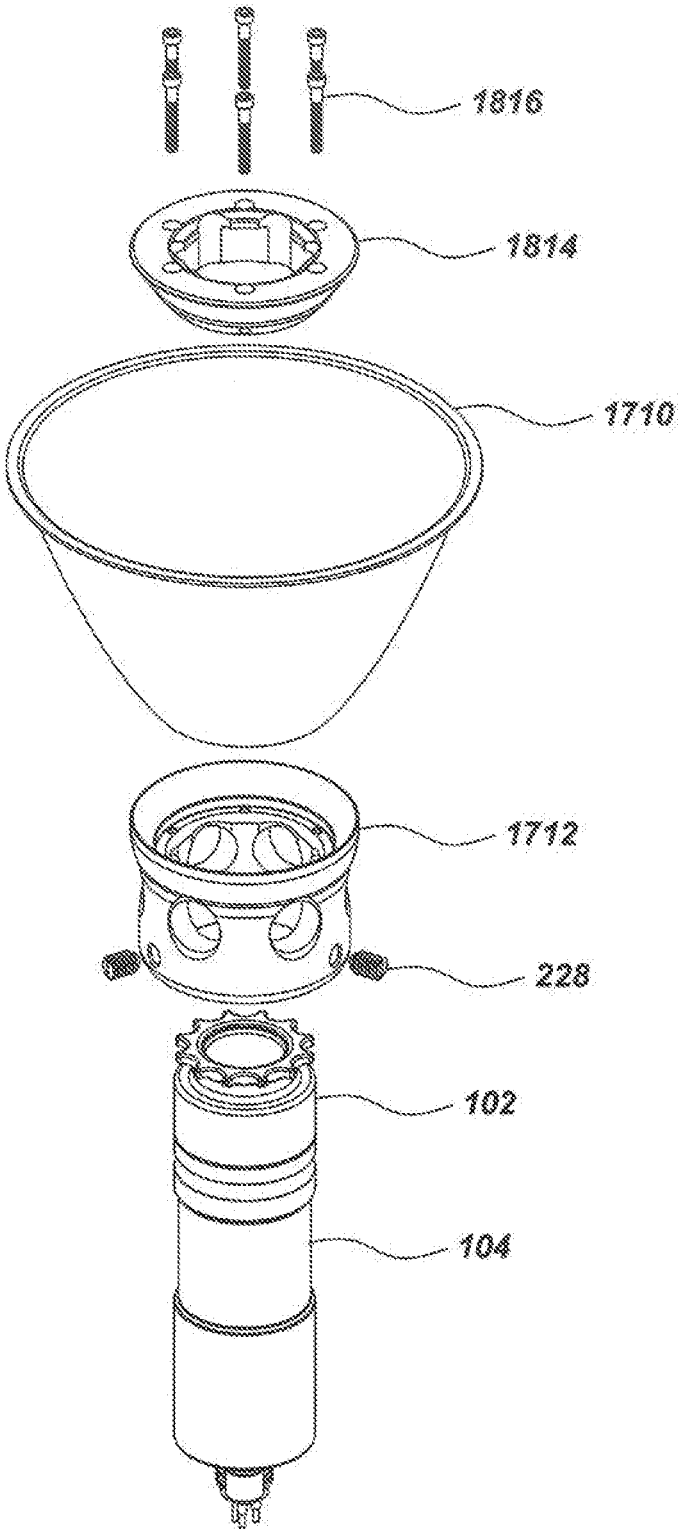
FIG. 19 depicts an isometric exploded view of the underwater multilayer LED light fixture of FIG. 17.

Attention is now drawn to FIG. 17, FIG. 18 and FIG. 19. FIG. 17 provides an isometric view of the exterior of an embodiment of the present disclosure in the form of an underwater multilayer LED light fixture. FIG. 18 may be an enlarged fragmentary view, taken along dimension 18-18 of FIG. 17, of a light head subassembly of FIG. 17. FIG. 19 depicts an isometric exploded view of the light head subassembly of FIG. 18. As shown, an aft reflector mounting collar 1712 couples to the aft housing 104 by way of the fastener(s) 228. Alternatively, the aft reflector mounting collar 1712 could couple to the forward housing 102. An external reflector 1710 may be seated into an opening of the aft mounting collar 1712, and then clamped between the aft mounting collar 1712 and a forward reflector mounting collar 1814. The two mounting collars 1712 and 1814 are coupled to each other by one or more collar clamp screws 1816.

Figure 20:
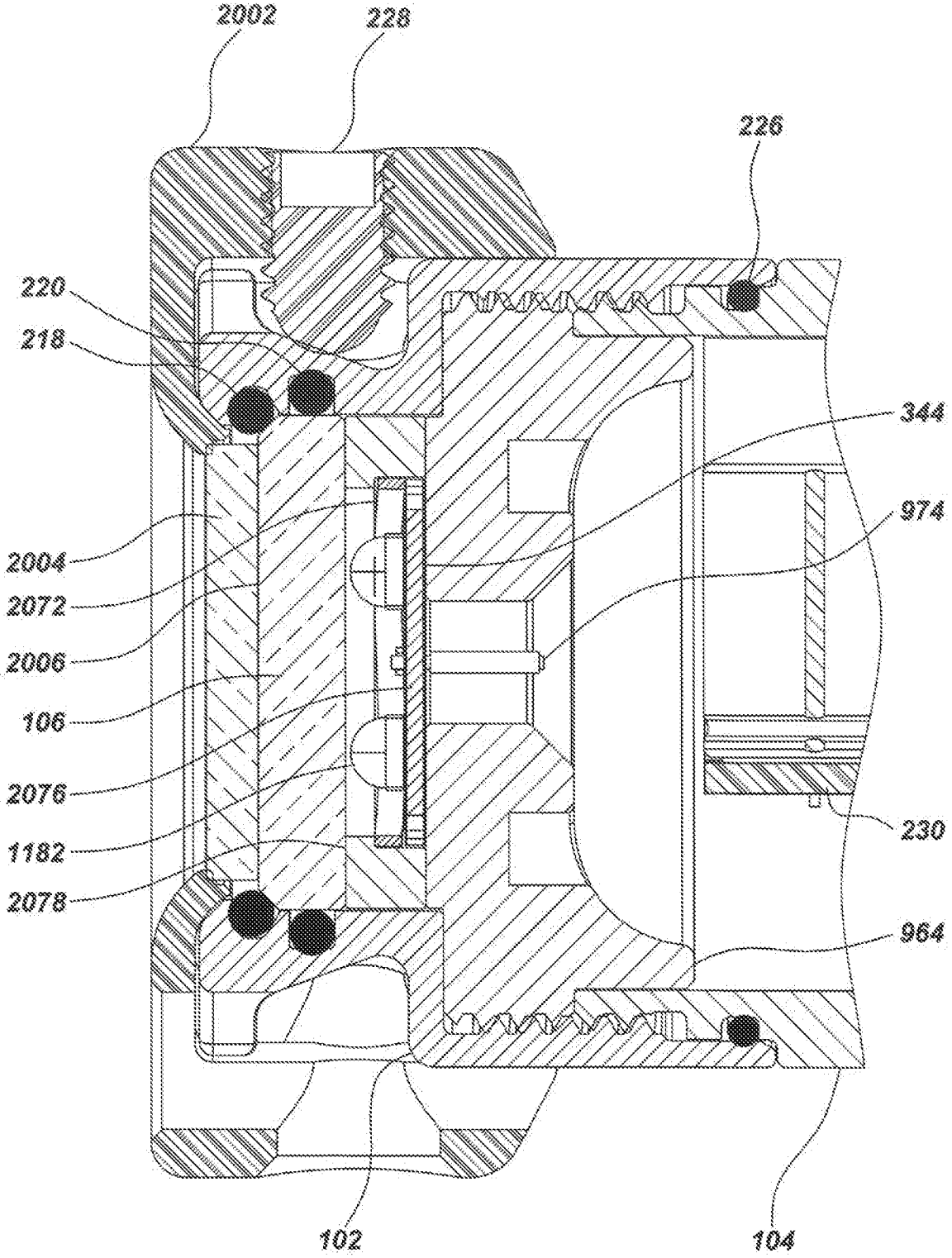
FIG. 20 depicts an enlarged section view of an alternate embodiment of the present disclosure incorporating a UV filter.
Figure 21:
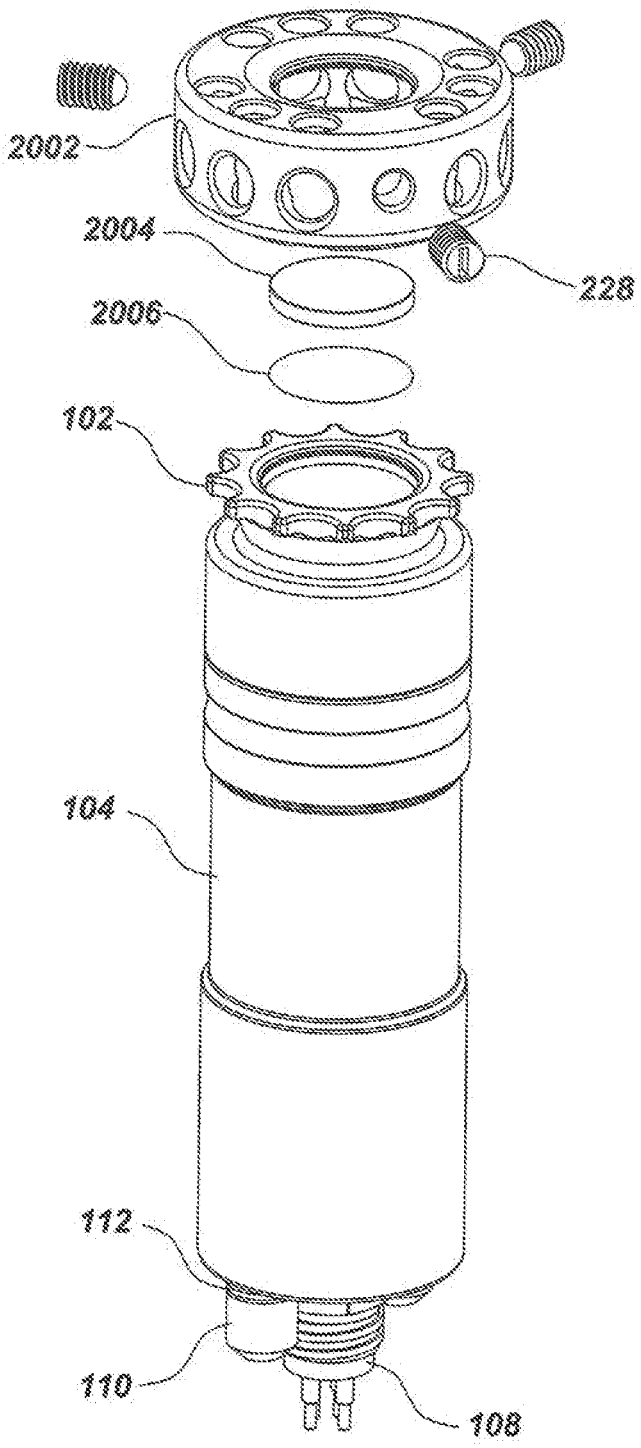
FIG. 21 depicts an isometric exploded view of the light head subassembly of FIG. 20.

Attention is now drawn to FIG. 20 and FIG. 21. FIG. 20 provides an enlarged section view of an alternate embodiment of the present disclosure incorporating a filter. FIG. 21 depicts an isometric exploded view of the light head subassembly of FIG. 20. As shown, a filter holder 2002 secures a filter 2004 (e.g., for UV, IR, absorption, or thin film multi-layer band pass) in front of a forward surface of the window 106. An optical coupling compound 2006 may be disposed between the filter 2004 and the window 106. The filter holder 2002 flexes when installed and preloads the filter 2004 against the window 106. The filter 2004 may be optionally coupled to window 106, and coupled using optically transparent grease to prevent bubbles and debris from entering the region between the filter 2004 and the window 106. Other ways of clamping the filter 2004 directly to the face of the window 106 are within the scope and spirit of this disclosure (e.g., an external clamp). The grease reduces Fresnel reflection losses between the filter 2004 and window 106 surfaces, and increases transmission efficiency. A sapphire window 106, for example, provides a high stiffness modulus, and flexes very little underneath the filter 2004. Therefore, the filter-to-window gap can be maintained in functional, optical contact with coupling grease.

FIG. 20 illustrates the annular window support structure 2078 that circumscribes the LED PCB 2076, which may be thermally clamped to pressure support structure 964 by a spring 2072 (e.g., a wave spring) configured to maintain the LED PCB 2076 and the LEDs 1182 at certain positions where transfer of thermal energy from the LEDs 1182 and the LED PCB 2076 may be optimized. The spring 2072, which can be made of Beryllium Copper or another thermally conductive material, may be also configured to draw thermal energy away from the LEDs 1182 and the LED PCB 2076.

Attention is now drawn to FIG. 22, FIG. 23 and FIG. 24. FIG. 22 provides an enlarged fragmentary view of a lower housing subassembly of FIG. 2 depicting the LED driver electronics 230 captured by the driver mount 232 inside of the aft housing 104. Features may be fashioned in the aft housing 104 that laterally capture the LED driver assembly, consisting of the LED driver electronics 230 and the driver mount 232, within the span formed by an aft housing backstop feature 2290 and the pressure support structure 216.

FIG. 23 provides another view of a portion of the lower housing subassembly of FIG. 22 illustrating the manner in which the driver mount 232 operates on the LED driver electronics 230 and aft housing 104. The driver mount 232 may be formed into the shape of an arc spanning across the chord formed by the LED driver electronics 230 along the inside diameter of the aft housing 104. The outward force generated by the driver mount 232 acting against the inner diameter of the aft housing 104 applies a downward force on a surface of the LED driver electronics 230 creating a friction lock, thermal clamp, and mechanical clamp between the driver electronics 230 and an inside surface of the aft housing 104. Additionally, the driver mount 232 may be formed with axial aligned bent tabs 2392 along the edges that press against a planar surface of the LED driver electronics 230 providing compliance to the spring formed by the driver mount operating on an inside surface of the aft housing 104. The spring force generated by the driver mount 232 operating between the aft housing 104 and the LED driver electronics 230 may serve to lessen the effect, on the LED driver electronics PCB 230, of vibrations and other mechanical movements acting on the aft housing 104.

FIG. 24 depicts an isometric exploded view of the lower housing subassembly of FIG. 22 illustrating the details of one embodiment of a curved mount. Additional keying tabs 2492 may be fashioned in the driver mount 232 that correspond with slotted segments 2494 along the edge of the LED driver electronics 230 that lock the position of the driver mount 232 relative to the LED driver electronics PCB 230. The keying tabs 2492 and the slotted segments 2494 may assist in insertion of the mounted LED driver assembly into the aft housing 104 in addition to providing resistance to lateral motion of the mounted LED driver in high vibration environments and during foreign object impacts. The LED driver mount 232 shown may be molded, pressed or otherwise formed to shape. In FIG. 24, the LED driver mount 232 includes coupling features that couple to the portions of the LED driver electronics 230 (e.g., the board). These coupling features may be designed to thermally couple to one or more portions of the LED driver electronics PCB 230. Thermal coupling between the LED driver electronics 230 and the aft housing 104, both directly through the mechanical clamp and through the driver mount 232 may be used to carry heat away from one or more portions of the LED driver electronics PCB 230. In other operation conditions it may be advantageous to carry heat into the LED driver electronics 230 through the thermal coupling formed by the driver mount 232 and the aft housing 104. In an exemplary application the thermal coupling to the LED driver electronics 230 may be used to communicate excessive heat buildup in the luminaire from one or more active LED elements to a temperature monitoring device (e.g., a temperature monitor 2622 of FIG. 26 described later herein) and trigger protective measures to maintain safe functioning of the luminaire.

A notable amount of heat flow occurs on an edge of a PCB of the LED driver electronics 230. Copper traces in this PCB may be specifically configured to move heat to the edge of the PCB and into the LED driver mount 232. Heat produced in the individual components of the LED driver electronics may be typically removed into the PCB and then from the PCB edge into the LED driver mount 232, where the heat is transferred to the inside surface of the cylindrical pressure housing.

Figure 25:
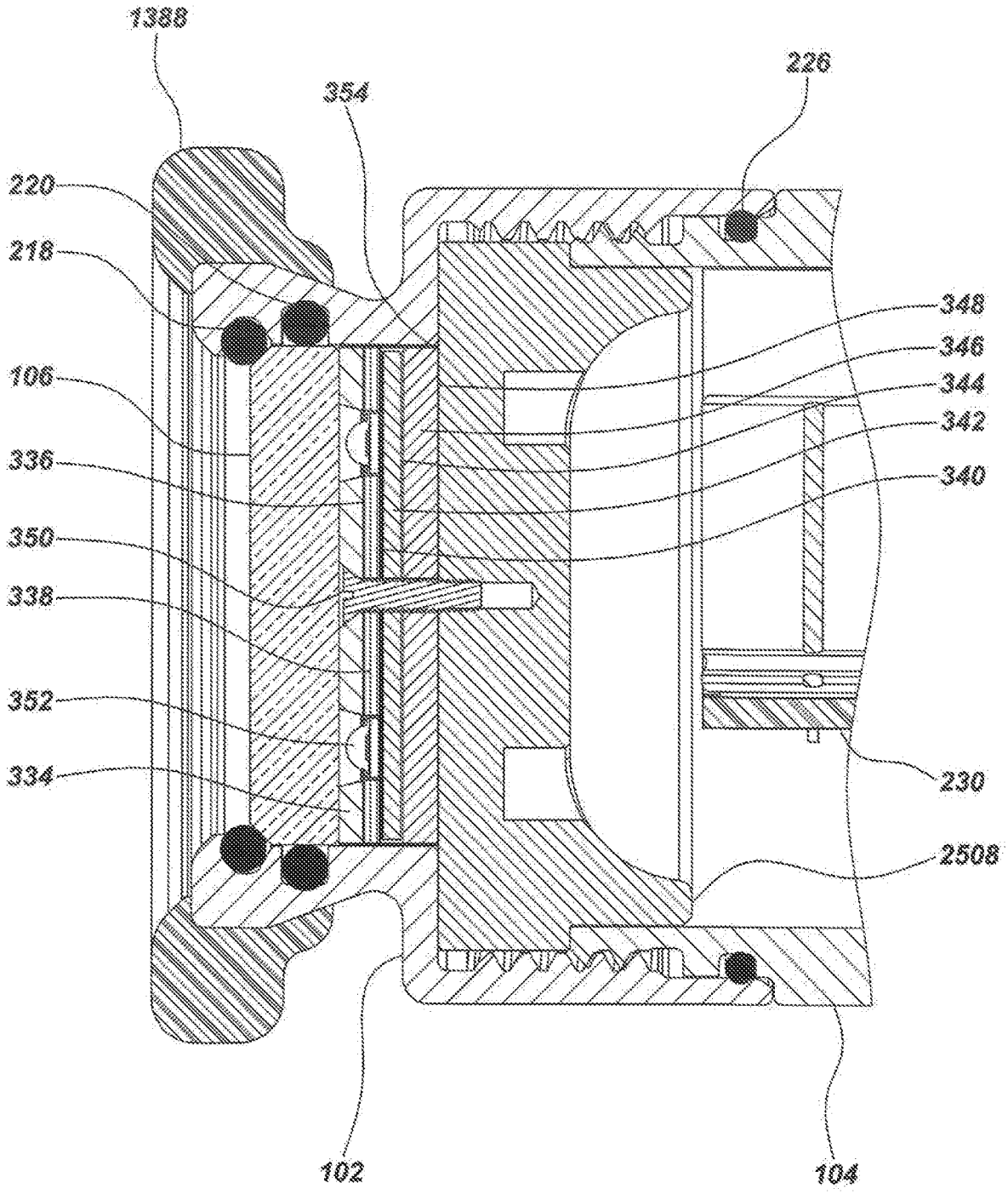
FIG. 25 depicts an enlarged section view of an alternate embodiment of the present disclosure incorporating a pressure support structure that is held in place by an aft housing that is screwed into a forward housing.

Attention is now drawn to FIG. 25, which depicts an enlarged section view of an alternate embodiment of the present disclosure incorporating a pressure support structure that may be held in place by an aft housing that may be screwed into a forward housing. As shown, a pressure support structure 2508 may be secured in place between a forward surface of the aft housing 104 and an aft surface of the forward housing 102. The pressure support structure 2508 may be held in place when the aft housing 104 may be screwed into the forward housing 102. Pressure exerted on the window 106 from the external environment may be transferred through various layers of components and carried on the pressure support structure 2508. When secured inside the forward housing 104, the pressure support structure 2508 provides a reliable and effective thermal contact between several, flat surfaces of the pressure support structure 2508 and several, corresponding interior surfaces of the forward housing 102.

Figure 30:
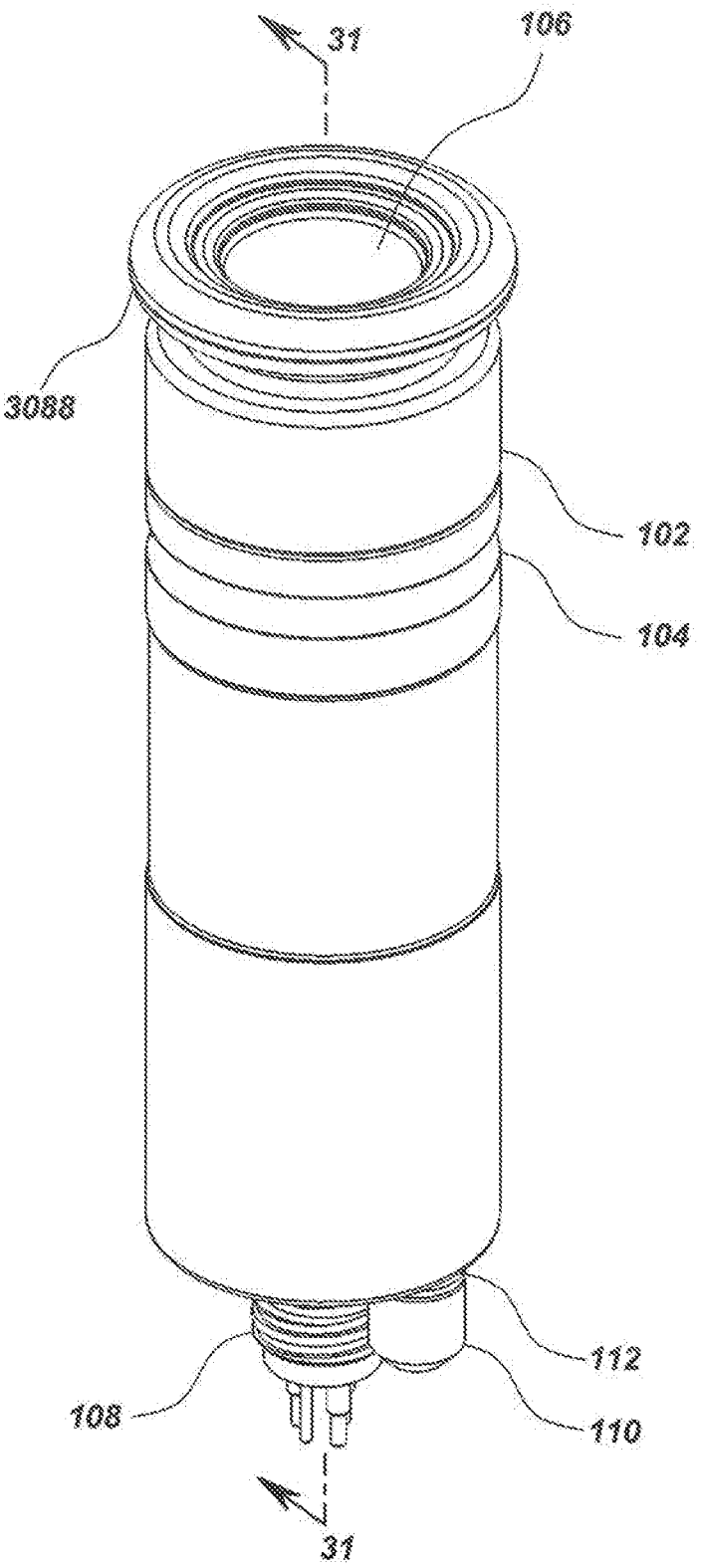
FIG. 30 depicts an isometric view of the exterior of an embodiment of the present disclosure in the form of an underwater multilayer LED light fixture.

Attention is now turned to FIG. 30, which depicts an isometric view of the exterior of an underwater multilayer light fixture/luminaire in accordance with one embodiment. As shown, the light fixture includes similar or the same features as illustrated in FIG. 1 and other figures. Description regarding those similar or same features is incorporated here for reference. FIG. 30 illustrates a crash guard 3088 that surrounds and protects the window 106, which resides within the forward pressure housing 102. The crash guard 3088 may be constructed of a molded elastomer (e.g., an elastomeric molding resin) that is stretched over the forward housing 102 during installation.

Figure 31:
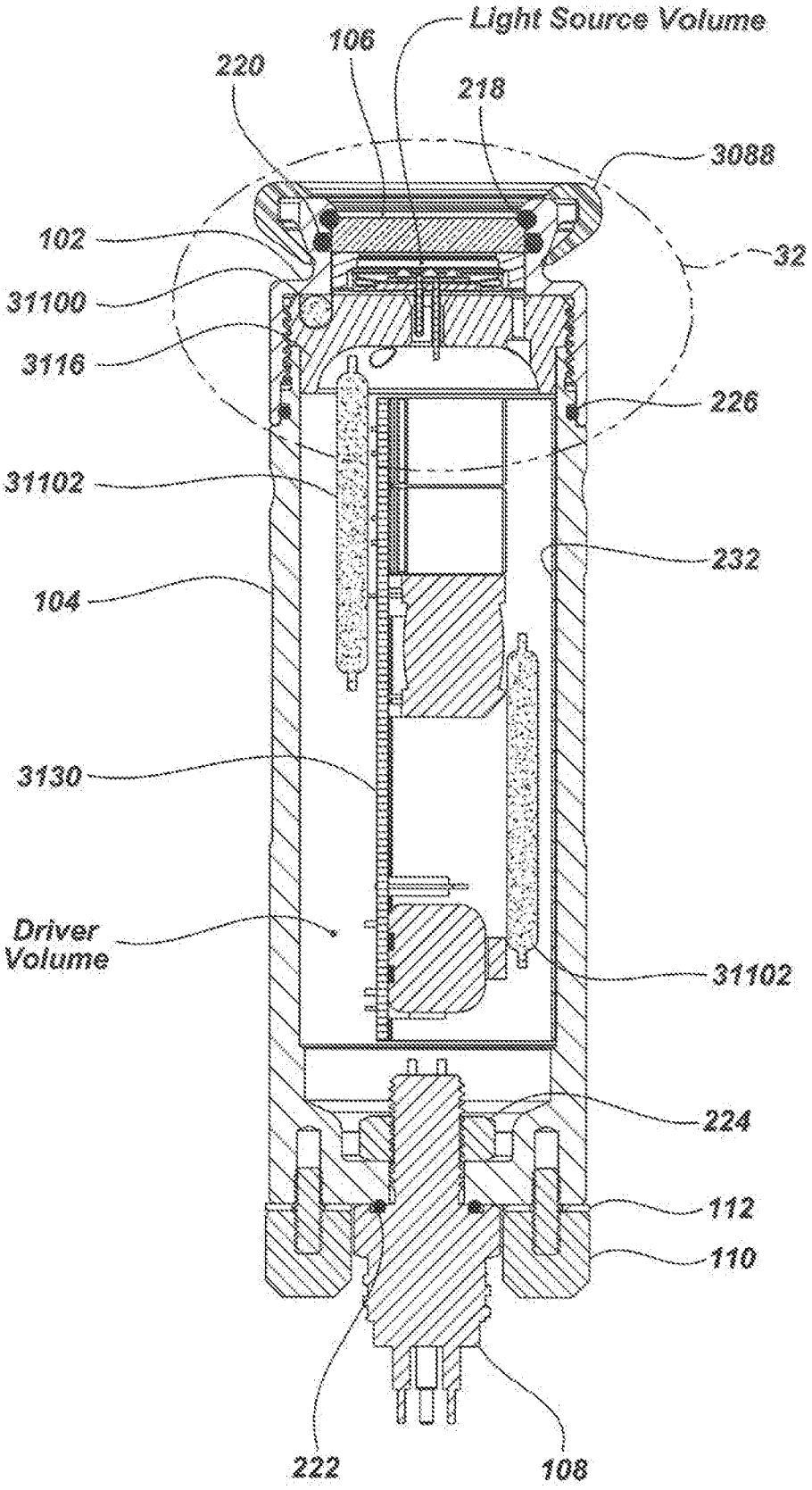
FIG. 31 is a vertical sectional side view of the underwater multilayer LED light fixture of FIG. 30.
Figure 32:
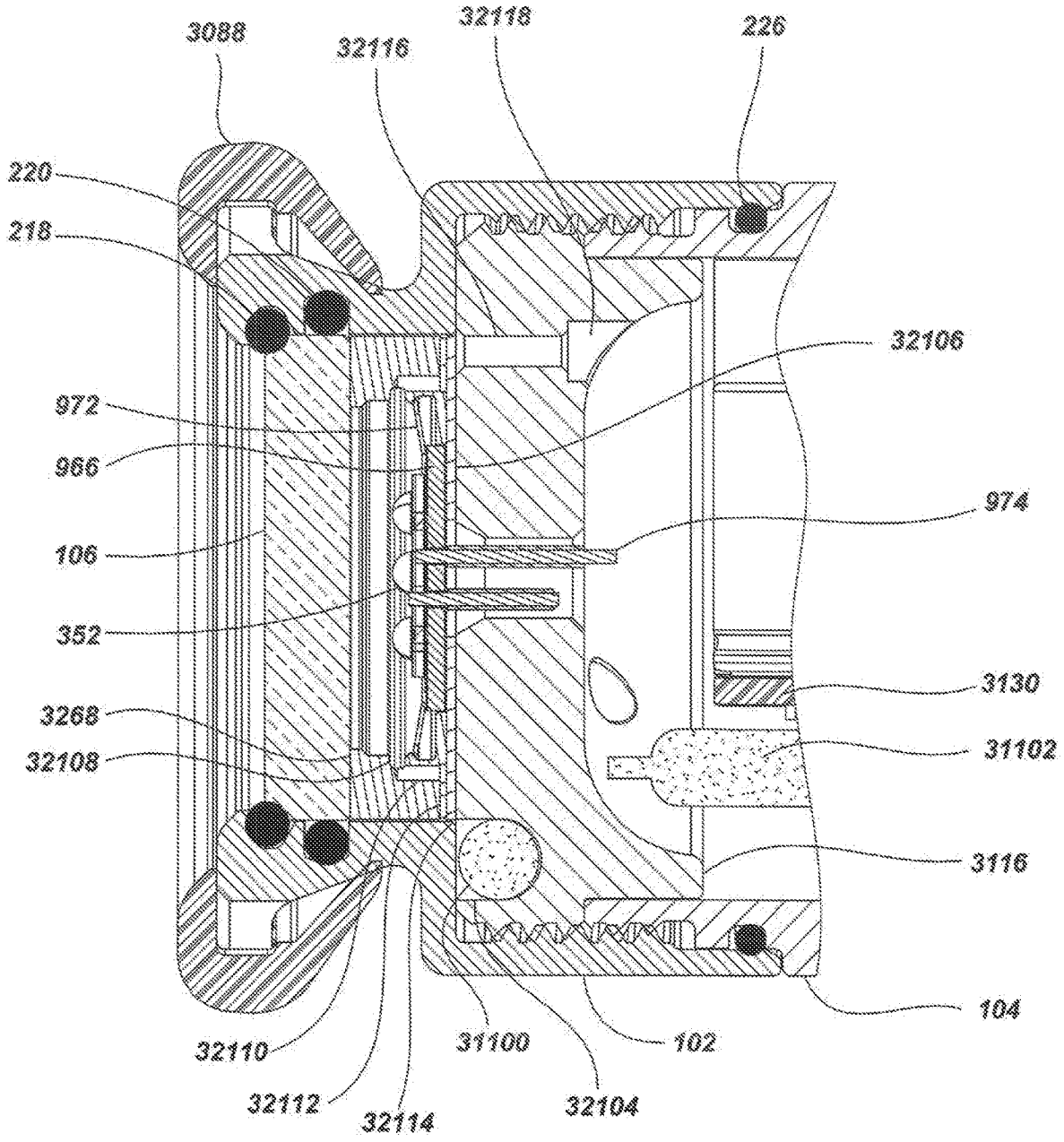
FIG. 32 is an enlarged fragmentary view of a stack subassembly of FIG. 31 illustrating the details of one embodiment of a multilayer stack.

FIG. 31 illustrates a vertical sectional side view, taken along dimension 31-31 of FIG. 30. As shown, the crash guard 3088 may be secured to the forward housing 102 by various means, including a snap configuration, a threaded configuration, or other suitable coupling configuration. FIG. 31 illustrates a stack subassembly inside the forward housing 104, comprising a vented pressure support structure 3116 configured to carry at least part of a load exerted onto the window 106 by external pressure (e.g., pressure associated with depths in a marine environment). The vented pressure support structure 3116 may be formed of various materials, including thermally-conductive materials such as copper or aluminum so as to permit heat transfer to and from neighboring features. Venting associated with the vented pressure support structure 3116 is illustrated in FIG. 32 and its corresponding description herein.

FIG. 31 also depicts a driver assembly that is positioned inside the aft housing 104. The driver assembly may include driver electronics 3130 that are coupled to a flexed metal sheet that forms the driver mount 232. One or more driver volumes may be formed inside the aft housing 104, and one or more light source volumes may be formed in the forward housing 102. For example, the parameters of a light source volume may be defined by a surface of one or more light sources (e.g., LEDs), a surface of the window 106, and/or a surface of other components in the forward housing 102.

One or more absorption/adsorption materials in the form of balls 31100, packets 31102 or other form may be placed in the forward housing 102 or the aft housing 104 as shown in FIG. 31. For example, absorption/adsorption balls 31100 may be placed in milled cavities disposed in the forward housing 102 that are further illustrated in FIG. 32. The absorption/adsorption packets 31102 may be fixed by known means within the aft housing 102, and may be attached to various features or components, including the driver electronics 3130, the driver mount 232, the inner wall of the aft housing 102, or another feature/component. Methods for attaching the absorption/adsorption materials include zip tying, or adhering with adhesives that do not release or release minimal amounts of contaminants that lead to LED browning, among other methods. One of skill in the art will appreciate that the absorption/adsorption materials may take any form that may be disposed in any housing such that substances may diffuse or travel from other areas of the housings to the absorption/adsorption materials.

Suitable absorption/adsorption materials may be selected to exhibit desired characteristics that mitigate undesired degradation of the light sources due to various atmospheric conditions in the forward housing 102 and/or aft housing 104. Such atmospheric conditions include release of gases or other contaminants in the internal atmosphere of the housings. Examples of suitable absorption/adsorption materials may include natural or synthetic zeolites (e.g., 3 angstrom zeolite, or other categories of zeolite). One of skill in the art will appreciate that other porous materials capable of absorbing or adsorbing substances may be used.

By way of example, light sources, including LEDs, may brown when in contact with certain gases or other substances that may be released into a light source volume. Outgassing is a common problem with electronics, where glues or other components may release contaminants into the atmosphere. In some instances, having a larger volume for diffusing contaminants is preferred. In other instances, sealing a light source volume from a contaminant-originating volume is preferred. Still, in other instances, absorbers/adsorbers are desired to collect contaminants in order to extend the life of a light source (e.g., an LED).

One of skill in the art will appreciate that the absorption/adsorption materials may be similarly applied to corresponding gap areas illustrated in other figures relating to other embodiments described herein (e.g., FIGS. 3, 5, 7, 9, 11, 13, 15, 20, 22, 23, and 25).

Figure 33:
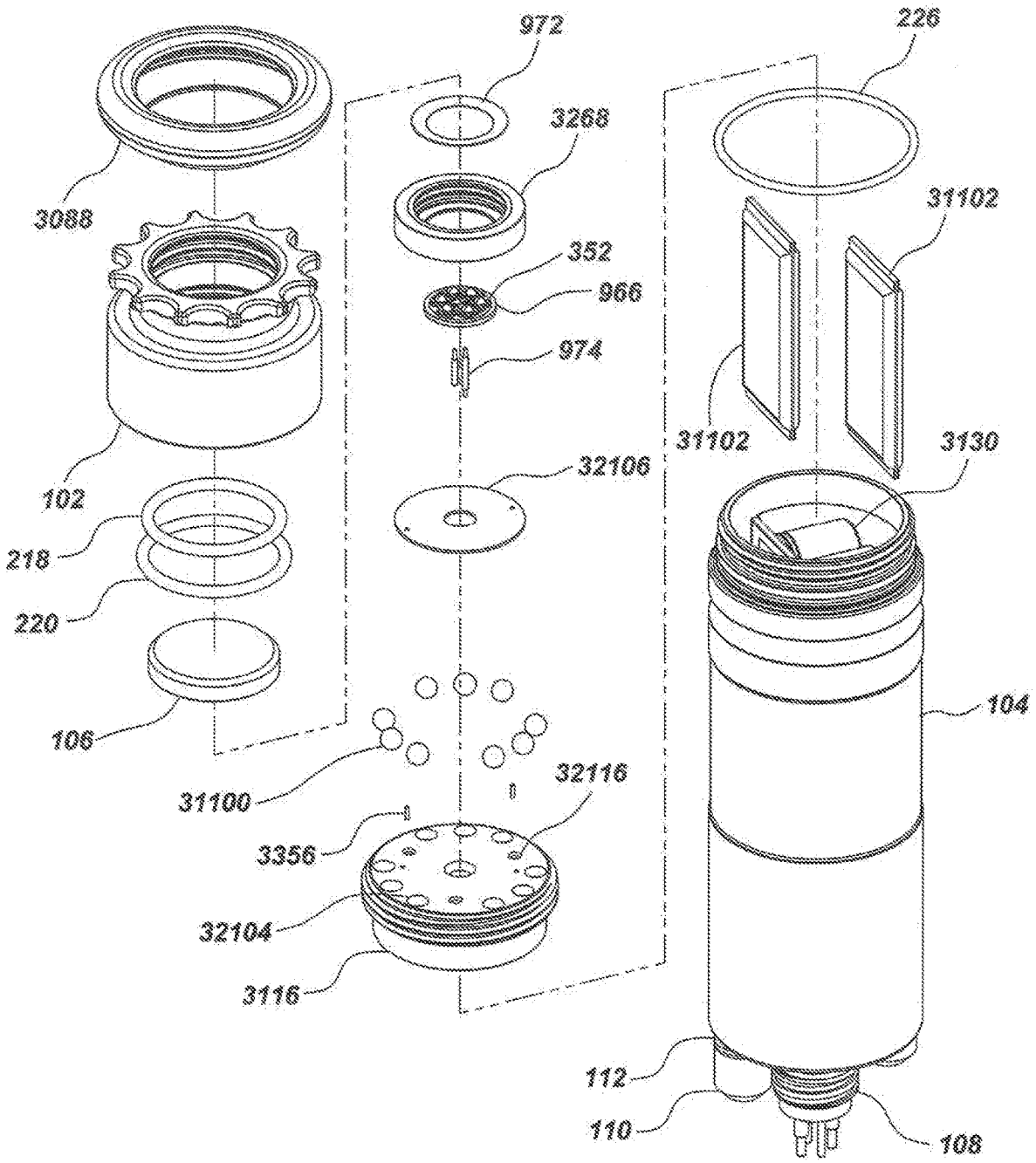
FIG. 33 depicts an isometric exploded view of the light head subassembly of FIG. 32.

Turning now to FIG. 32 and FIG. 33. FIG. 32 provides an enlarged fragmentary view of the stack subassembly of FIG. 31, while FIG. 33 depicts an isometric exploded view of the light head subassembly of FIGS. 31-32. The stack subassembly, which may be inserted through one open end of the forward housing 102 and positioned behind the window 106, may include the vented pressure support structure 3116, a vented window support structure 3268, and a printed circuit board (PCB) 966 (e.g., a metal core PCB) populated with one or more LEDs 352.

The vented pressure support structure 3116 may include one or more ab sorption/adsorption cavities 32104 within which the absorption/adsorption materials (e.g., ball 31100) may reside. A vapor channel may be formed between the light source volume and the absorption/adsorption balls 31100 via a groove 32108 formed in the vented window support structure 3268, which is connected to passages 32110, 32112 and 32114 that permit gases or other harmful atmospheric substances to travel from the light source volume to the absorption/adsorption balls 31100, where those substances are absorbed or adsorbed. One of skill in the art will appreciate that the groove 32108 and/or the passages 32110-14 may be formed in between other components in the forward housing 102, or formed into various components.

The vented pressure support structure 3116 is shown to accommodate both conductive and convective thermal transfer. For example, the vented pressure support structure 3116 may be formed of conductive material that draws heat away from the light source volume and other components. The vented pressure support structure 3116 also includes a passage 32116 that convectively draws heat away from other components in the forward housing 102. The passage 32116, which connects to a hole 32118 (e.g., a spanner wrench hole for tightening the vented pressure support structure 3116 into the forward housing 102), may also permit contaminants in the atmosphere of the forward housing 102 to enter the aft housing 104 where absorption/adsorption packets 31102 reside to collect those contaminants.

FIGS. 32 and 33 also illustrate a thermal coupling layer 32106 disposed between and possibly coupled to either or both of the vented pressure support structure 3116 and the PCB 966. The layer 32106 may be formed from suitable materials that have high thermal conductivity in order to direct the thermal energy away from the LEDs 352 to walls of the forward housing 102 (indirectly through other components or via direct coupling) for transfer to the ambient environment outside of the forward housing 102. Thus, thermal transfer may occur longitudinally/vertically through a volume of the layer 32106 to the vented pressure support structure 3116, or latitudinally/laterally along the layer 32106 to a wall of the forward housing 102 or other component.

One of skill in the art will appreciate that the layer 32106 may be disposed between other components, or that its material may be used for other components.

Improved thermal transfer may be achieved by allowing layer 32106 to extend beyond a heat producing light source (e.g., the LEDs 352) to make direct contact with additional thermal paths such as a path through a window support structure to a window 106, or other paths through components or features that lead to the external environment.

Certain materials, like a monolayer carbon graphite material (e.g., a pyrolytic graphite sheet (PGS)), may be formed to exhibit high thermal conductivity along a latitudinal surface plane as compared to thermal conductivity through the material along a longitudinal axis. In accordance with some implementations, a PGS layer may be formed by compressing PGS material under a pressure load to reduce a vertical dimension of the PGS material to as low as one-third of its uncompressed vertical dimension.

Compression may be performed to increase heat transfer along a lateral plane of the PGS layer (e.g., the flat surface of the layer 32106). Such compression may be accomplished by inserting the PGS material between two hard and flat surfaces (e.g., stainless steel), and then applying up to or greater than 10,000 PSI of pressure (e.g., with a hydraulic press) to reduce a vertical dimension of the PGS material along a longitudinal axis to as low as one-third of the original vertical dimensions. Alternatively, the PGS material could be compressed at certain depths where a luminaire is in use.

Compression of a PGS layer before operation of a luminaire at certain marine depths may prevent compression of an uncompressed PGS layer at those depths during operation. Without pre-operation compression, the luminaire may fail due to shrinking, at those certain depths, of its internal pressure support stack profile.

A sealed PGS layer may be achieved by coating compressed PGS material with a non-melting silicone lubricating material (e.g., high vacuum grease) or other sealant. Otherwise, not applying the lubricating material or other sealant may result in an unsealed, porous PGS layer configured to allow substances to pass through the PGS layer.

It is further contemplated that the lubricating material or other sealant may be mixed with diamond dust to further enhance thermal transfer properties of the thermal coupling layer 32106.

FIG. 33 also illustrates pins 3356 that may be used to limit rotation of various components with respect to each other in the forward housing 102.

Attention is now drawn to FIGS. 34-37.

Figure 34:
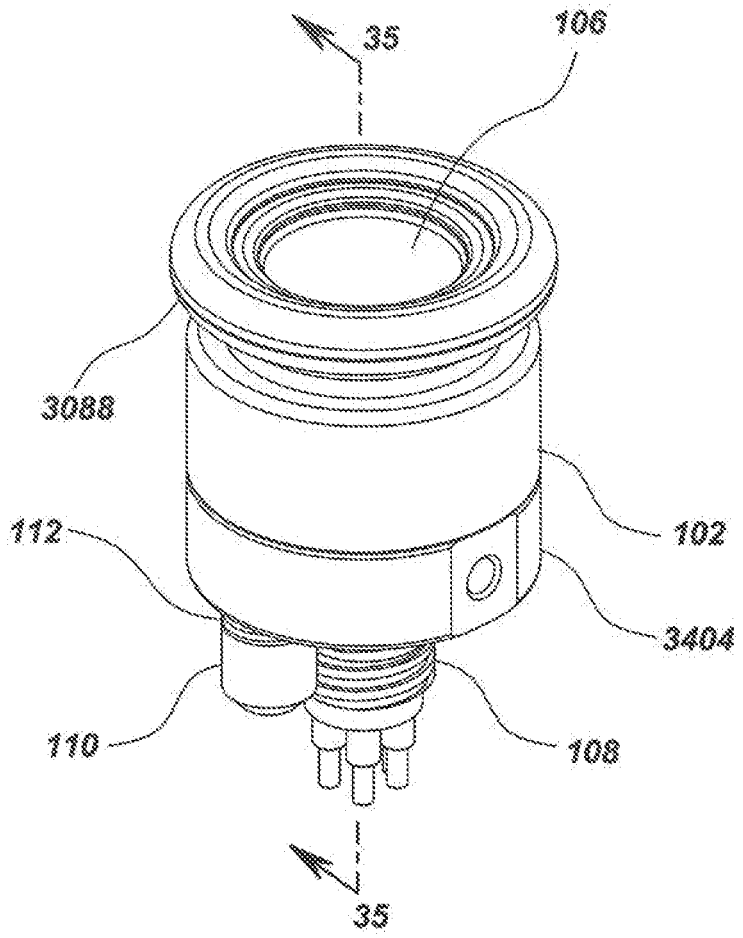
FIG. 34 depicts an isometric view of the exterior of an embodiment of the present disclosure in the form of an underwater multilayer LED light fixture.

FIG. 34 depicts an isometric view of the exterior of an underwater multilayer light fixture/luminaire in accordance with one embodiment. As shown, the light fixture includes similar or the same features as illustrated in FIG. 1 and other figures. Description regarding those similar or same features is incorporated here for reference.

As shown, FIG. 34 illustrates a shorter, aft housing 3404 as compared to the longer, aft housing 104 depicted in previous figures. The implementation shown in FIG. 34 advantageously permits relocation of driver electronics, which permits a shorter profile luminaire. One of skill in the art will appreciate that dimensions of any component, including the aft housing, may be varied to permit different implementations of any aspect disclosed herein.

Figure 35:
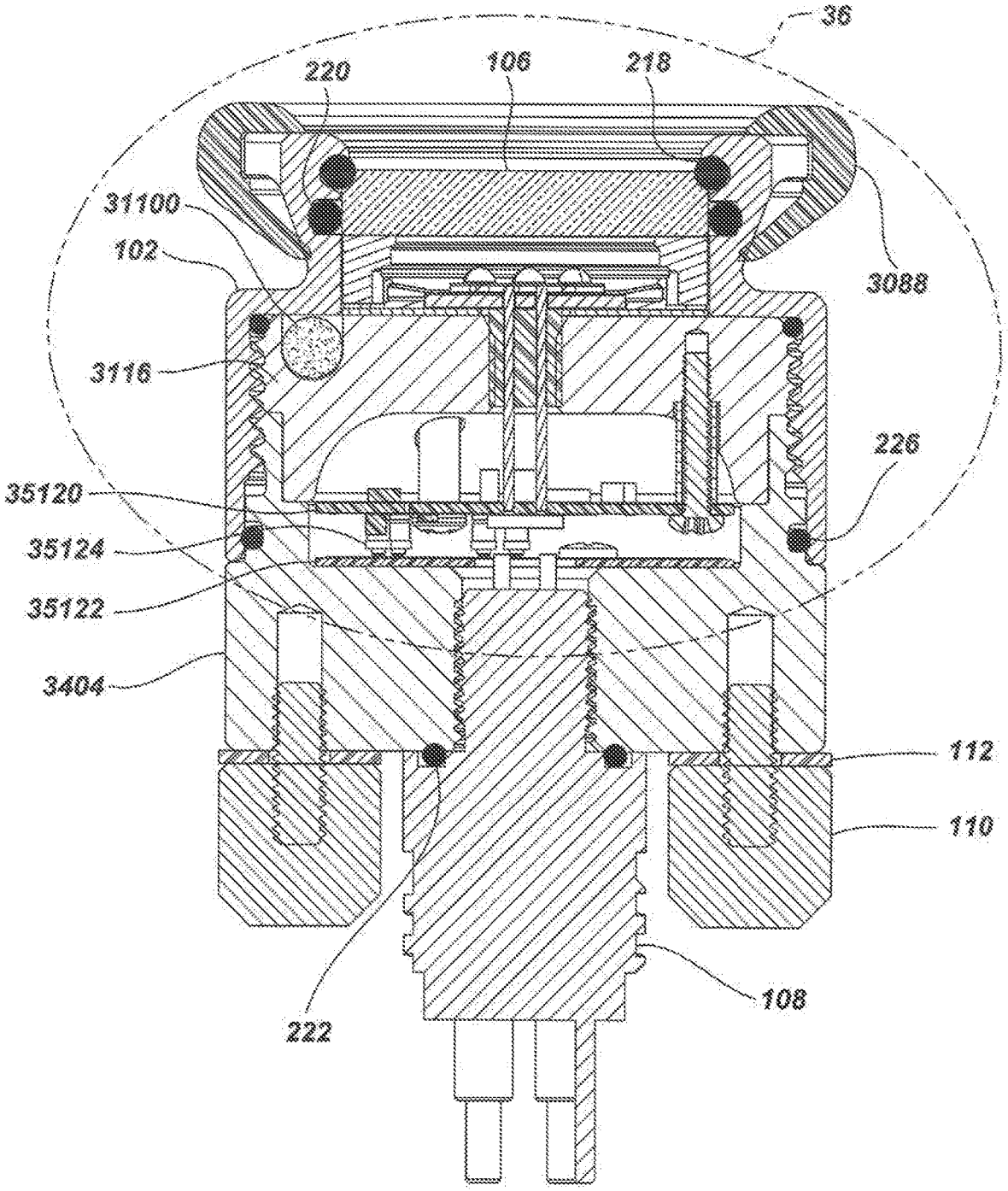
FIG. 35 is a vertical sectional side view of the underwater multilayer LED light fixture of FIG. 34.
Figure 36:
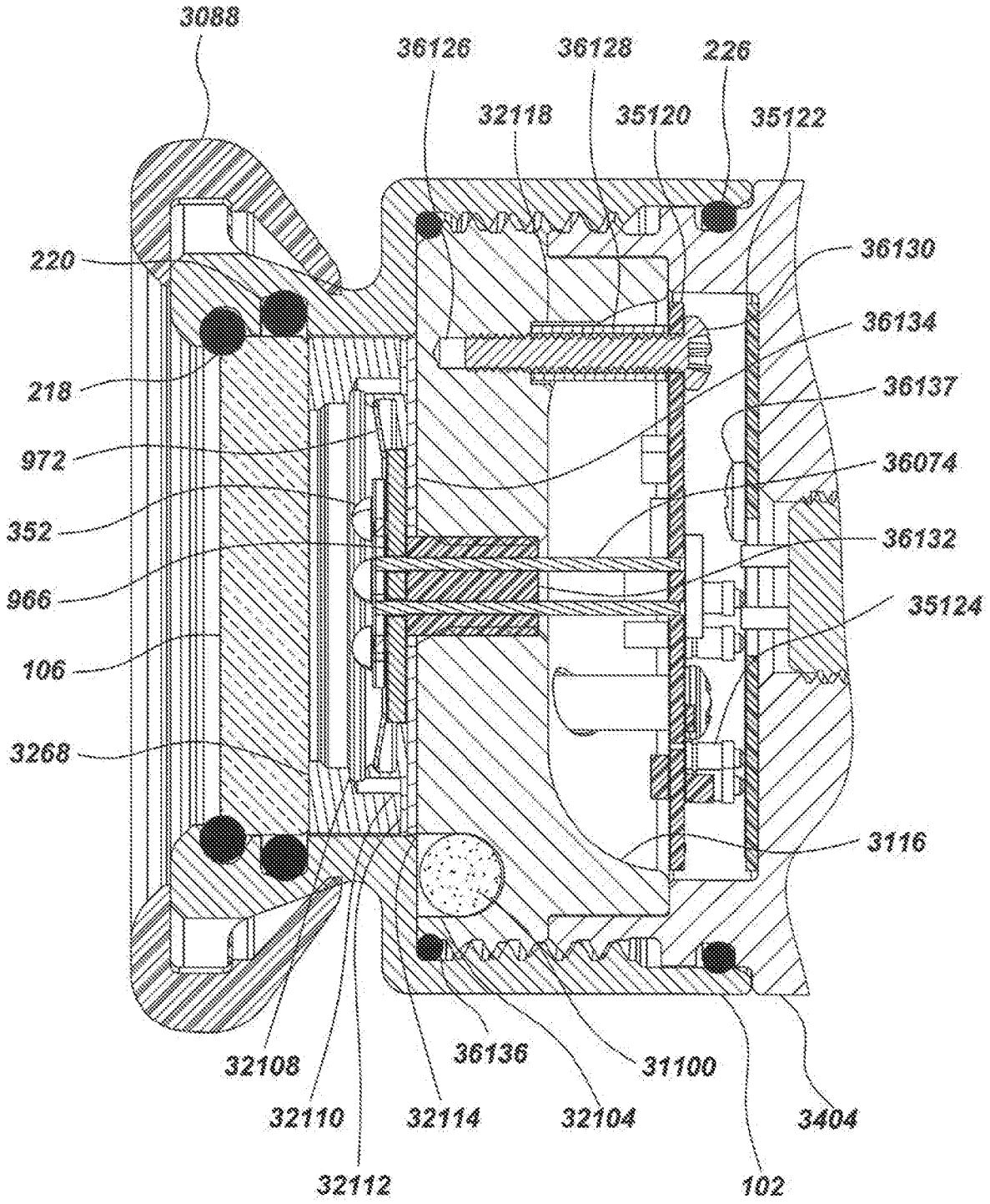
FIG. 36 is an enlarged fragmentary view of a stack subassembly of FIG. 35 illustrating the details of one embodiment of a multilayer stack.
Figure 37:
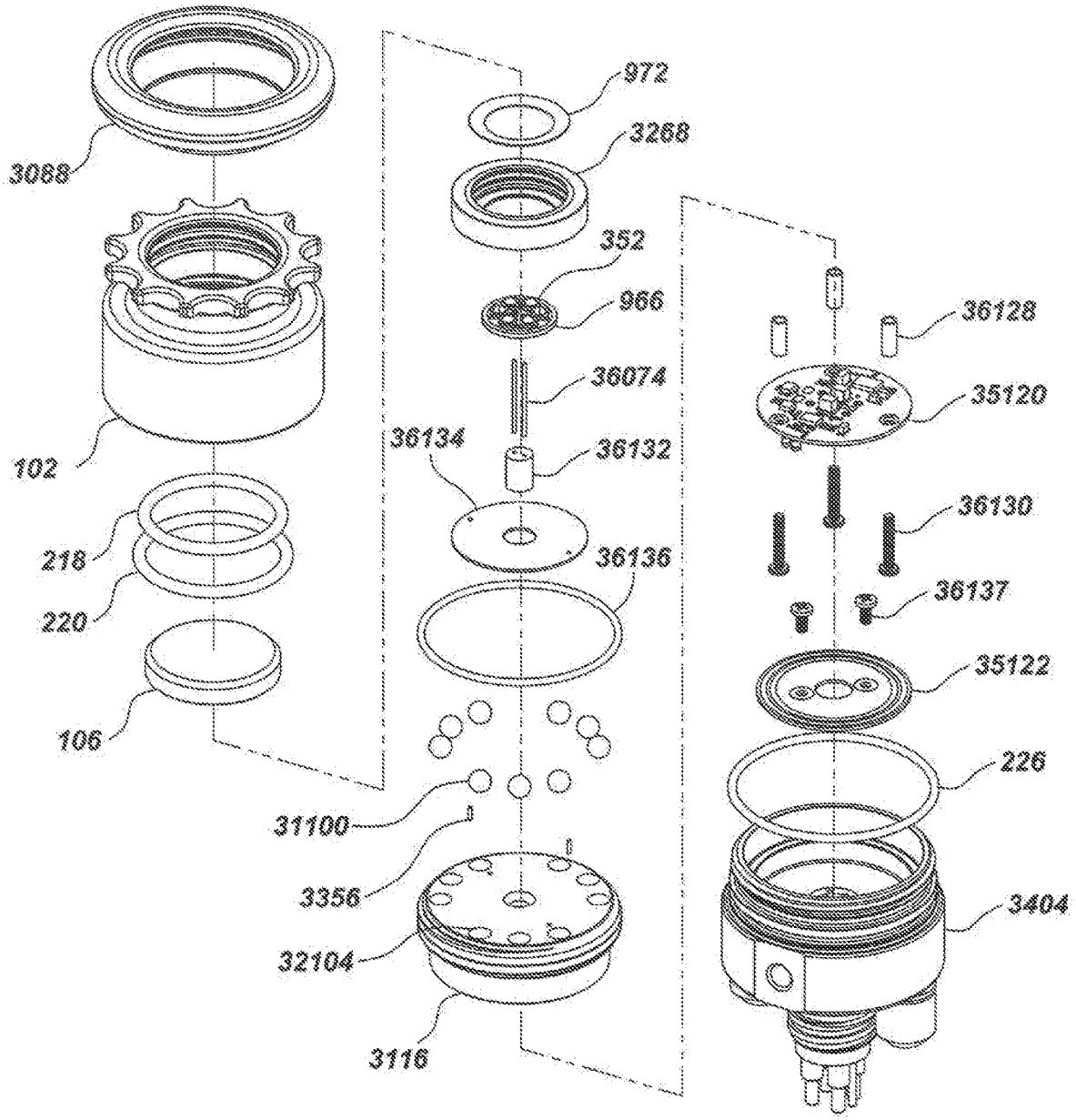
FIG. 37 depicts an isometric exploded view of the light head subassembly of FIG. 36.

Attention is now drawn to FIGS. 35 and 36, which illustrate a sectional side view of the light fixture of FIG. 34 taken along dimension 35-35. Reference is also drawn to FIG. 37, which depicts an isometric exploded view of the light head subassembly of FIGS. 35-36.

In accordance with one aspect, FIGS. 35-36 depict the aft housing 3404, a LED PCB protection circuit 35120, a slip ring interface PCB 35122, a spring contact 35124, a threaded fastener 36130, an LED PCB pin/electrical connection seal 36132, a thermal coupling layer 36134 (e.g., a compressed PGS disc), and a threaded fastener 36137 for PCB 35122.

As shown, the LED PCB protection circuit 35120 may be fastened to the pressure support structure 3116 or the pressure support structure 116 shown in other figures. Circuit 35120 may contain circuitry to protect the LEDs 352 from errant power sources such as high voltage, high currents, and reverse polarity voltages and currents. Circuit 35120 may further contain circuitry to provide thermal protection of the LEDs 352 by disconnecting the LEDs 352 from input power when a maximum temperature threshold is exceeded. Once temperature near the LEDs 352 decreases to below the maximum temperature threshold, the circuit 35120 may reconnect the LEDs 352 to input power. Protection of the LEDs 352 may be needed where exceeding maximum threshold voltage, current, reverse polarity voltage/current, and temperature situations would destroy the LEDs 352.

The slip ring interface PCB 35122 may be fastened to the aft housing 3404. The PCB 35122 may be electrically connected to conductors in the underwater connector 108. The spring contacts 35124 may be attached to the LED PCB protection circuit 35120 by either mechanical fasteners, soldering, or perhaps a molded carrier, and act as an interconnect between the LED PCB protection circuit 35120 and the slip ring interface PCB 35122. Pins are positioned to line up with the concentric rings of the slip ring interface PCB 35122 so that, upon coupling of the forward housing 102 and aft housing 3404, electrical contact will be made from the tracks on the slip ring interface PCB 35122 and the LED PCB protection circuit 35120.

The LED PCB pin/electrical connection seal 36132 may be configured to seal around LED PCB electrical contact pins that could otherwise allow substances to pass through without the seal 36132.

In accordance with another aspect, FIGS. 35-36 depict a configuration where one or more volumes in the forward housing 102 are sealed from one or more volumes in the aft housing 3404. Sealing the two volume spaces may be accomplished by various means known in the art, including a sealing O-ring (e.g., O-ring 36136). By sealing the two volume spaces, contaminants and other substances in the aft housing 3404 may be prevented from entering a light source volume in the forward housing 102, where those substances could adversely affect the lifespan and other characteristics of LEDs 352.

Attention is now drawn to FIG. 26, FIG. 27, FIG. 28 and FIG. 29, which depict variations on electronic ballasts for LED luminaires that deliver constant current power to an LED array.

Figure 27:
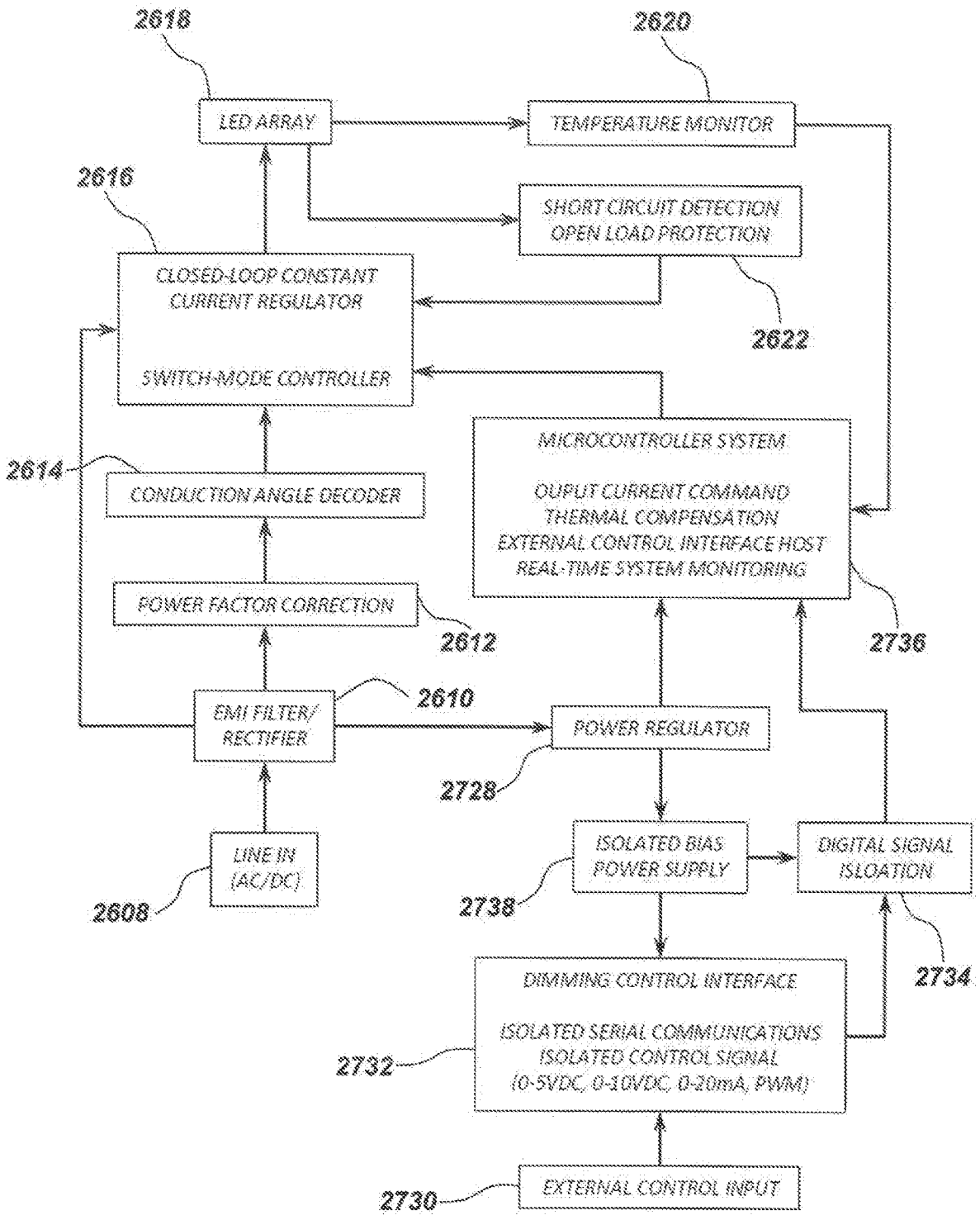
FIG. 27 depicts a block diagram of LED driver electronics using high voltage AC/DC with an isolated control interface.
Figure 28:
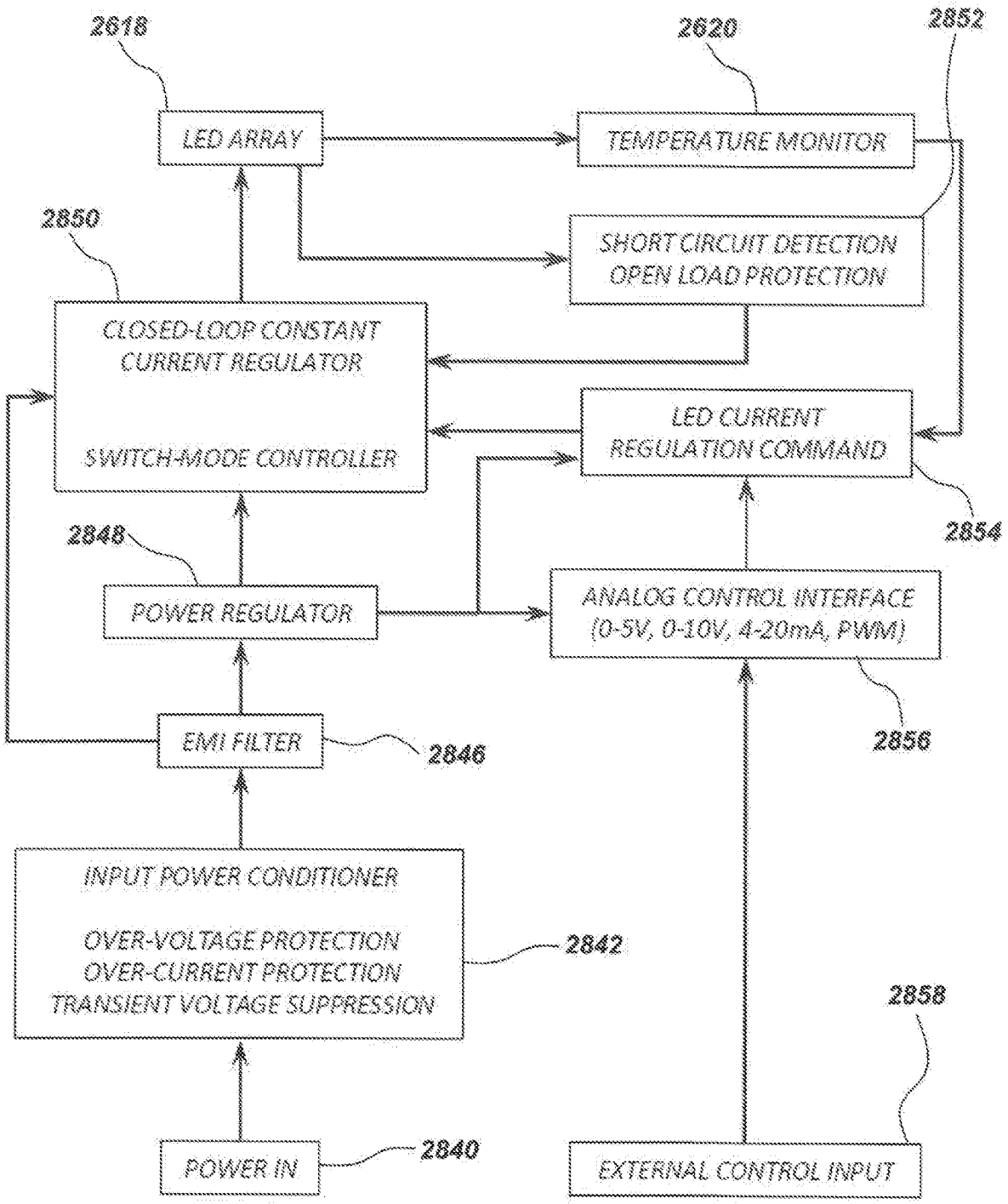
FIG. 28 depicts a block diagram of LED driver electronics using low voltage DC.
Figure 29:
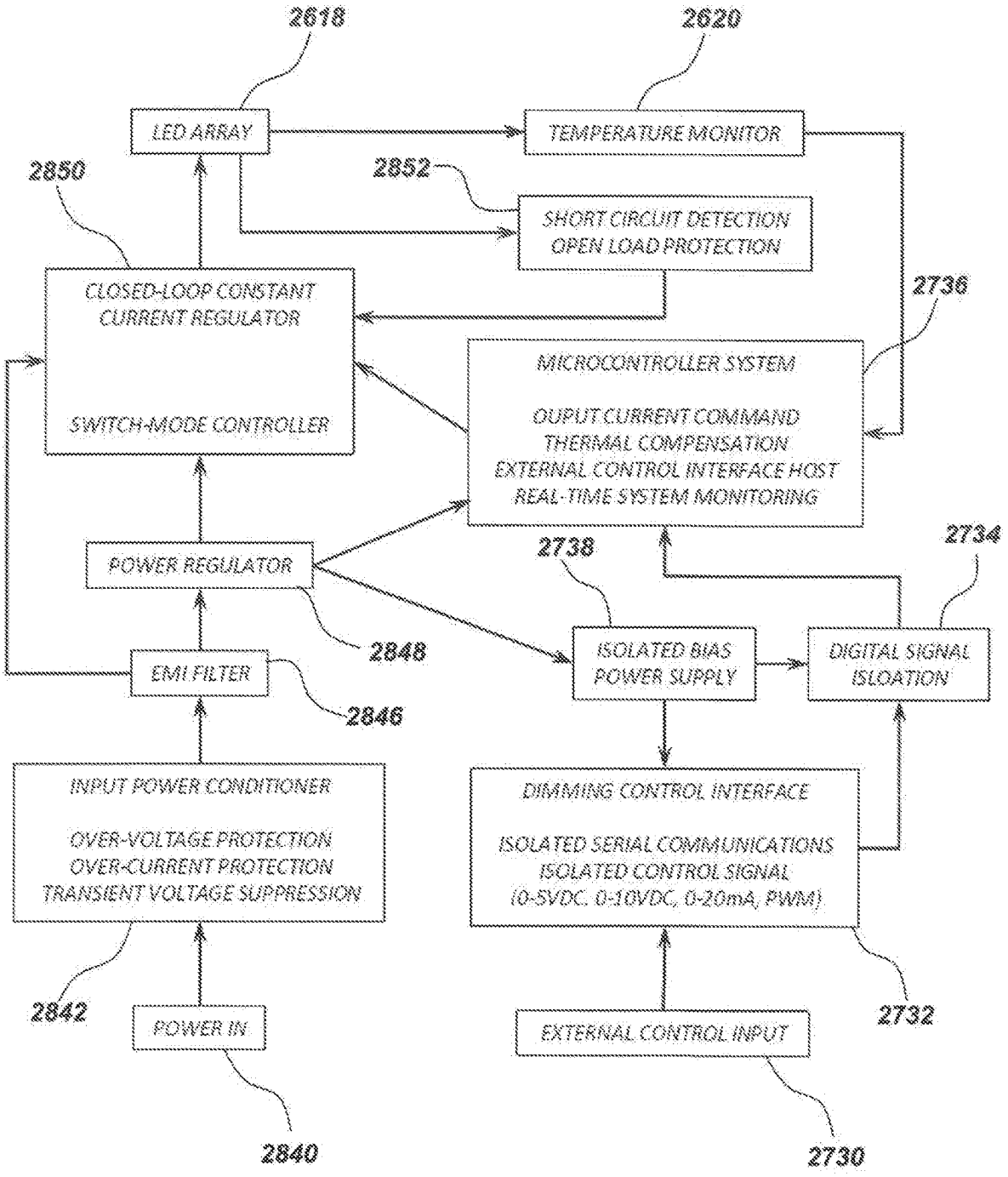
FIG. 29 depicts a block diagram of LED driver electronics using low voltage DC with isolated control interface.

Design of LED driver electronics may follow two, different circuit topologies, including one for high voltage AC/DC power supplies (e.g., FIGS. 26 and 27), and another for low voltage DC power supplies (e.g., FIGS. 28 and 29). Companion microcontroller systems, controlled by an analog/digital/serial control interface, may be used to control and monitor the ballast. The microcontroller system and isolated control interface may enable advanced features not available in simpler implementations. "Linear" or "Switch-Mode" controllers may be used.

Each variation converts some input power range into an intermediate voltage and then, through the use of a closed-loop electronic controller, regulates a constant current through an LED array. The variations of drivers all incorporate internal protections such as LED short-circuit detection, open LED load protections, and system temperature monitoring designed to maintain safe functioning of the LED luminaire across a wide operating envelope. Additionally every variation incorporates means for dimming the LED luminaire by modulating the output current delivered to the LED array. Temperature monitoring devices 2620 may optionally be mounted on or adjacent to the LED Array 2618 or on the LED driver electronics PCB or both to provide adequate monitoring of critical device temperatures.

Figure 26:
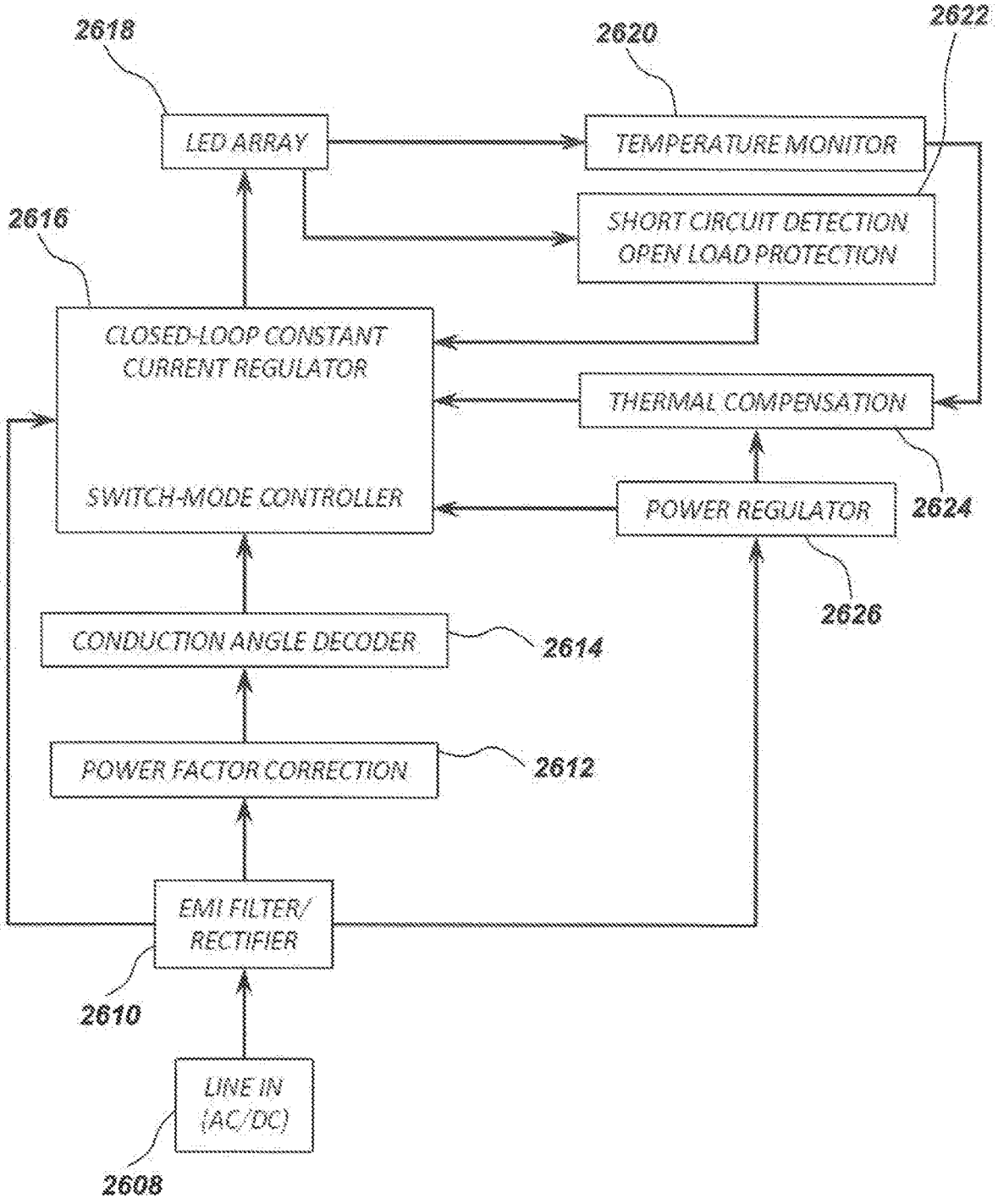
FIG. 26 depicts a block diagram of LED driver electronics using high voltage AC/DC.

FIG. 26 illustrates the manner in which a constant current ballast for use on high voltage AC/DC power sources and common utility power grids delivers regulated power to an LED array in an LED luminaire. Power from the AC/DC power source 2608 passes through an input rectifier and electromagnetic interference (EMI) filter 2610 then through a closed-loop switch-mode power regulator to the LED array 2618. A power regulator 2626 converts the output of the EMI filter and rectifier 2610 into an internal power supply for the switch-mode power controller 2616 and other peripheral circuitry. The output of the EMI filter and rectifier 2610 may be also fed into a power factor correction circuit 2612 that keeps the input current in phase with the input voltage in order to minimize reactive losses and maintain a high overall system efficiency. User control of the output current may be provided through conduction angle decoder 2614 which measures the characteristic waveforms from phase-cut dimming controllers which then proportionally modulates the output current delivered by the closed-loop switch-mode power regulator 2626. Temperature feedback from the LED array 2618 may be used to compensate the output current through control signals tied to the closed-loop switch-mode current regulator 2616. A temperature monitor 2620 can optionally be mounted on or adjacent to the LEDs or on the LED driver PCB, or both (e.g., resulting in temperature sensing in both locations).

FIG. 27 illustrates a further variation of the constant current LED luminaire ballast depicted in FIG. 26 maintaining all of the functional elements from FIG. 26 while incorporating additional advanced features. In this variation, a microcontroller system 2736 interfaces with the closed-loop switch-mode regulator 2616 to control LED current regulation command and thermal compensation, while providing a host interface to an isolated external command and control system. Power from the internal power supply may be fed through to an isolated bias power supply 2738 to power up the dimming control interface 2732. Several means of commanding the output current are provided through the dimming control interface 2732 including but not limited to 0-5 volt, 0-10 volt, and 0-20 milliamp analog signals, pulse-width modulated (PWM) digital signals, and digital serial communications interfaces such as EIA-485, EIA-232, USB, and Ethernet. The external control input 2730 may be digitized by the dimming control interface 2732 and packetized into a serial communications command transmitted across the isolation barrier through the digital signal isolator 2734. The serial command may be interpreted by the microcontroller system 2736 and used to command the closed-loop current regulator 2616 to dim the LED luminaire. Other functions are provided over the isolated serial communications link such as, but not limited to, real-time system monitoring, tracking of time in service, system fault logs, and ballast diagnostic and prognostic functions.

The block diagram in FIG. 28 illustrates a variation of constant current ballast for use on low voltage DC power sources such as those found in battery powered applications. DC power may be applied to the input of the ballast and pre-conditioned by an input power conditioner 2842 that provides protections against connection to higher than rated voltage power sources, high input current transients, and over-voltage transients. The pre-conditioned power then passes through an EMI filter 2846 and then on to a closed-loop switch-mode current regulator 2850 that provides a constant current to the LED array 2618. An external control input 2858 may be scaled by the analog control interface 2856 and then combined with thermal feedback to set the LED current regulation command signal to the closed-loop switch-mode current regulator 2850. The external control input can be, but may be not limited to, 0-5 volt, 0-10 volt, 0-20 milliamp, and PWM signals and provides external means of dimming the LED luminaire.

FIG. 29 illustrates a further variation of the constant current LED ballast depicted in FIG. 28 which integrates the additional functions enabled by the microcontroller system 2736 and isolated dimming control interface 2732 described in FIG. 27 with the low voltage DC constant current ballast of FIG. 28.

Certain aspects of the present disclosure generally relate to minimizing or eliminating external, metal components that may corrode over time, thereby causing the LED light fixture to fail. Other aspects relate to reducing sizes of luminaires by eliminating components. Such size reductions may allow for additional components that were previously unavailable under certain circumstances. Still, other aspects relate to using thinner materials that may lead to enhanced thermal conductivity and strength combinations.

It may be understood that the specific order of steps or arrangement of components disclosed herein are examples of exemplary approaches. Based upon design preferences, it may be understood that the specific order of steps or components may be rearranged while remaining within the scope of the present disclosure unless noted otherwise.

The previous description of the disclosed embodiments may be used to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the scope of the present disclosure is not intended to be limited only to the embodiments shown herein but should be accorded the widest scope consistent with the principles and novel features disclosed herein.

The disclosure is not intended to be limited to the aspects shown herein, but should be accorded the fullest scope consistent with the specification and drawings, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" may be intended to cover: a; b; c; a and b; a and c; b and c; and a, b and c.

While various embodiments of the present multilayer LED light have been described in detail, it will be apparent to those skilled in the art that the present disclosure can be embodied in various other forms not specifically described herein. The innovative structures described herein are applicable to a wide variety of submersible luminaires besides deep submersible LED light fixtures. Therefore, the protection afforded to the presently claimed invention should only be limited based on the following claims and their equivalents.

We claim:

1. An LED underwater light, comprising:

a housing with a forward portion having an opening and an aft portion, the housing enclosing an inner volume;

a transparent, pressure-bearing window having an external face and an internal face, the pressure bearing window positioned across the forward portion opening; wherein the external face is positioned facing outward and the internal face is positioned facing the volume;

a water-tight seal disposed between the transparent, pressure bearing window and a surface of the housing;

an LED light assembly including an electronic circuit board and a plurality of LEDs operatively coupled to the electronic circuit board;

wherein the electronic circuit board is an element of a multilayer stack assembly enclosed in the volume, the multilayer stack assembly also including at least an LED spacer element placed between the transparent pressure bearing window and the electronic circuit board and a heat sink element, wherein the LED spacer element has a plurality of apertures for allowing light emitted from the LEDs to pass through to the transparent pressure bearing window and to the exterior of the housing; and wherein the transparent pressure bearing window and the multilayer stack are positioned so that substantially all of the pressure applied to the external face of the window is transferred to and carried through the electronic circuit board and other elements of the multilayer stack assembly.

2. The underwater light of claim 1, wherein the housing is thermally coupled to the heat sink element of the multilayer stack to transfer heat generated by the plurality of LEDs to the housing and to an external environment.

3. The underwater light of claim 1, wherein the housing is substantially cylindrical or spherical in shape.

4. The underwater light of claim 1, wherein the housing is a two piece housing including a forward housing element and an aft housing element; wherein the forward housing element and the aft housing element are mechanically coupled together to be water tight.

5. The underwater light of claim 1, wherein the multilayer stack includes a light engine metal clad printed circuit board (MCPCB) populated with the plurality of LEDs, and an LED spacer including apertures for allowing light emitted from the LEDs to pass through to the transparent, pressure bearing window, and wherein the LED spacer is positioned between the transparent pressure bearing window and the MCPCB.

6. The underwater light of claim 5, wherein the multilayer stack further comprises a window support spacer positioned between the LED spacer and the transparent, pressure bearing window.

7. The underwater light of claim 6, wherein the multilayer stack further comprises an insulating film positioned between the LED spacer and the transparent pressure bearing window.

8. The underwater light of claim 7, wherein the insulating film comprises a Kapton™ material.

9. The underwater light of claim 6, wherein the window support spacer comprises a high compressive strength material with apertures shaped to fit around the LEDs to allow light from the LEDs to pass therethrough.

10. The underwater light of claim 1, wherein the window comprises sapphire.

11. The underwater light of claim 1, further comprising a crash guard positioned in front of the transparent, pressure-bearing window.

12. The underwater light of claim 11, wherein the crash guard is constructed of a high impact materials comprising plastics, polymers, titanium, stainless steel, or nickel-based alloys.

13. The underwater light of claim 1, wherein the electronic circuit includes a current regulator circuit to drive the LEDs.

14. The underwater light of claim 13, wherein the electronic circuit includes a thermal compensation circuit operatively coupled to the current regulator to provide a control signal for the regulator circuit output.

15. The underwater light of claim 14, wherein the electronic circuit includes a temperature monitor circuit, operatively coupled to the current regulator circuit, to sense heat generated by the LEDs and provide an output to the thermal compensation circuit.

16. The underwater light of claim 15, wherein the electronic circuit includes a short circuit detection open load protection circuit operatively coupled to the LEDs and the current regulator.

* * * * *